US012559919B2

(12) United States Patent
Thomson et al.

(10) Patent No.: US 12,559,919 B2
(45) Date of Patent: Feb. 24, 2026

(54) ATTACHMENT ASSEMBLY AND GROUND ENGAGING ASSEMBLY FOR EARTHMOVING EQUIPMENT

(71) Applicant: WEARFORCE PTY LTD, Kewdale (AU)

(72) Inventors: Andrew Thomson, Canning Vale (AU); Bruce Mcdonald, Gosnells (AU); Kevin Chapman, Lathlain (AU)

(73) Assignee: Wearforce Pty Ltd, Kewdale (AU)

( * ) Notice: Subject to any disclaimer, the term of this patent is extended or adjusted under 35 U.S.C. 154(b) by 518 days.

(21) Appl. No.: 18/000,412

(22) PCT Filed: Sep. 29, 2021

(86) PCT No.: PCT/AU2021/051135

§ 371 (c)(1),
(2) Date: Dec. 1, 2022

(87) PCT Pub. No.: WO2022/067383

PCT Pub. Date: Apr. 7, 2022

(65) Prior Publication Data

US 2023/0220652 A1 Jul. 13, 2023

(30) Foreign Application Priority Data

Sep. 29, 2020 (AU) ..... 2020903512
Aug. 25, 2021 (AU) ..... 2021221771

(51) Int. Cl.
*E02F 9/28* (2006.01)

(52) U.S. Cl.
CPC ..... *E02F 9/2833* (2013.01)

(58) Field of Classification Search
CPC ..... E02F 9/2833
See application file for complete search history.

(56) References Cited

U.S. PATENT DOCUMENTS 1,018,035 A 2/1912 DeLeeuw
6,976,670 B1 12/2005 Woolley et al.
(Continued)

FOREIGN PATENT DOCUMENTS

EP 3 263 775 A1 1/2018
WO 93/16239 A1 8/1993

OTHER PUBLICATIONS

International Search Report and Written Opinion dated Nov. 15, 2021 (Application No. PCT/AU2021/051135).
(Continued)

*Primary Examiner* — Nicole Coy
(74) *Attorney, Agent, or Firm* — Brown & Brown IP Law PLLC

(57) ABSTRACT

An attachment assembly (25) and a ground engaging assembly for releasable attachment with earthmoving equipment is disclosed. In at least one embodiment, the attachment assembly (25) comprises a first body (30) configured for being placed in affirmative engagement with a portion (32) of or in fixed relation with respect to an edge of or associated with the earthmoving equipment. The attachment assembly (25) comprises a second body (35) configured for being placed in affirmative engagement with a portion of the ground engaging tool (GET, $\mathbf{15}_C$ or 15). An operable element (40) is arranged so as to operably associate the first (30) and second (35) bodies so as to be responsive to operation of the operable element (40) in a first mode (mode I), in which one of the bodies (30, 35) is moved or driven away from the alternate body on the GET being received with respect to said edge, the separation of the bodies operating to apply a force to said portion of the GET for holding the GET ($\mathbf{15}_C$) with respect to said edge, and, a second mode of operation (mode II), in which one of the bodies is driven/moved toward
(Continued)

the alternate body for removal of the GET (15$_C$). Embodiments of a ground engaging assembly are also disclosed.

16 Claims, 17 Drawing Sheets

(56) References Cited

U.S. PATENT DOCUMENTS

| | | | | |
|---|---|---|---|---|
| 9,447,564 | B2 * | 9/2016 | Kunz | E02F 9/2833 |
| 9,540,796 | B2 * | 1/2017 | Dallard | E02F 9/2841 |
| 2003/0007831 | A1 | 1/2003 | Lian et al. | |
| 2020/0157782 | A1 | 5/2020 | Bjerke | |

OTHER PUBLICATIONS

English translation of the International Preliminary Report on Patentability (Chapter II) dated Sep. 1, 2022 (Application No. PCT/AU2021/051135).
Australian Search Report dated Jun. 18, 2021 (Application No. 2020903512).

* cited by examiner

ATTACHMENT ASSEMBLY AND GROUND ENGAGING ASSEMBLY FOR EARTHMOVING EQUIPMENT

FIELD OF THE INVENTION

An attachment assembly for releasably attaching a ground engaging tool to earthmoving machinery is disclosed. A ground engaging assembly for use with earthmoving machinery is also disclosed.

RELATED APPLICATIONS

The present application claims priority to Australian provisional patent application No. 2020903512 filed 29 Sep. 2020, and Australian patent application No. 2021221771 filed 25 Aug. 2021, the contents of which are incorporated herein by reference in their entirety.

BACKGROUND

Ground engaging tools (GET) such as for example teeth and shrouds used on the edge or edges of excavator buckets of earthmoving equipment in mining operations, operate in highly abrasive environments, are subjected to high impact forces and therefore wear out or become damaged through use. As such, GETs tend to require regular replacement once they come to the end of their useful life.

Depending on how the GET is attached to its host excavator bucket, their replacement can be complex, time-consuming and relatively expensive.

Accordingly, it is posited that there exists a need/market for a solution that seeks to provide a balance to the above considerations. It is therefore against this general background that the embodiments described herein have been developed.

SUMMARY

According to a first aspect, there is provided an attachment assembly for releasably securing aground engaging tool (GET) with earthmoving equipment, the attachment assembly comprising:

- a first body configured for placement in affirmative engagement with a portion of or in fixed relation with respect to an edge of or associated with the earthmoving equipment;
- a second body configured for placement in affirmative engagement with a portion of the GET;
- an operable element operably associating the first and second bodies so as to be responsive to operation of the operable element in a first mode in which one of said bodies is moved or driven away from the alternate body on the GET being received with respect to said edge, the separation of the bodies operating to apply a force to said portion of the GET for holding the GET with respect to said edge, and a second mode in which one of said bodies is moved or driven toward the alternate body for removal of the GET.

Embodiments of the above described aspects, and those describe below, may comprise, either individually or in combination, any of the following features.

In one embodiment, said edge of or associated with the earthmoving equipment is a leading edge or a leading edge portion of a lip portion or lip component of or associated with an excavator bucket of the earthmoving equipment (eg. earthmoving vehicle). Said lip portion or lip component may comprise or be exemplified in the form of one or more plate and/or cast weld-on lip segments formed for use with various types of excavator buckets used in various forms of ground engaging operations. In one form, such lip portion(s), lip component(s), or the or each plate and/or cast weld-on lip segment(s) are associated with the relevant excavator bucket by way of being connected therewith (eg. using any appropriate connection technique/process, eg. welding). In the present context, the leading edge or leading edge portion of the lip portion or lip component could be ref erred to as a wear edge. As such, for ease of explanation, reference to the leading edge or leading edge portion of the lip portion or lip component will be by way of the term 'wear edge'.

In one embodiment, the GET comprises a body having a ground engaging region at a first end of the body. The body of the GET comprises a leg portion which extends away from the first end of the body and which is spaced from the body so as to define a first opening configured for snugly receiving a portion of the wear edge during fitment of the GET prior to operating of the attachment assembly in the first mode of operation for holding/securing the GET against the wear edge.

In one embodiment, the holding of the GET with the earthmoving equipment in the first mode of operation involves subjecting the GET to the force by way of the moving or driving of one of the bodies away from a distal extent of the leading edge while the alternate body remains in fixed relation relative to said distal extent so as to separate the bodies via operation of the operable element. In this manner, the force to which the GET is subject is in a direction away from the leading edge. In one form, the force to which the GET is subject is in a direction away from the leading edge substantially toward the earthmoving equipment.

In one embodiment, the removal of the GET in the second mode of operation involves reducing a force being applied to the GET for holding same against the wear edge by way of reducing the separation of the bodies via operation of the operable element.

In one embodiment, said portion of or in fixed relation with the wear edge is provided in the form of a boss arranged in fixed relation with an excavator bucket of the earthmoving equipment at or near the wear edge. In one form, the boss is welded in its position at or near the wear edge of the excavator bucket (but could be bolted in position or cast-in, for example).

In one embodiment, affirmative (or positive) engagement between the first body and the boss is by way of an interconnection between the first body and the boss.

In one embodiment, the first body is configured at or near a first end thereof so as to interconnect with the boss, the interconnection between the first body and the boss serving to place both in fixed relation with each other in at least one freedom of movement, for example, along a first axis running substantially parallel with an axis extending away from the wear edge or its distal extent.

In one embodiment, the first body is configured at or near a first end thereof so as to interconnect with the boss, the interconnection between the first body and the boss serving to place both in fixed relation with each other in a direction substantially orthogonal to the wear edge or its distal extent.

In one embodiment, the interconnection between the first body and the boss serves to place both in fixed relation with each other in two freedoms of movement, for example, the freedoms of movement being along the first axis and a second axis aligned substantially orthogonal with the first axis (for example, the second axis may run substantially parallel with the face of the wear edge or its distal extent).

In one embodiment, the interconnection between the first body and the boss serves to place both in fixed relation with each other in three freedoms of movement, for example, the freedoms of movement being along the first, second axes and along a third axis aligned substantially orthogonal with the first and second axes.

In one embodiment, the first body comprises a hole opening to a surface provided at or near a second end of the body, the second end being opposite the first end of the body. The hole could be a blind hole or one that extends through the first body.

In one embodiment, a portion of the interior surface of the hole comprises a thread (for example, a female thread). In one form, said thread is provided or extends from at or near an inward disposed end of the hole of the first body.

In one embodiment, the operable element is rotatable about an axis of rotation. In one form, said axis of rotation is aligned substantially parallel with the first axis.

In one form, the operable element is of cylindrical form having an axis about which the operable element is movable or rotatable, whereby rotation of the operable element in one direction of rotation serves to enable operation of the first mode, and rotation in the alternate direction of rotation serves to enable operation of the second mode.

In one embodiment, the operable element comprises or is provided in the form of a piston having a head portion and a shaft portion extending from the head portion. The head portion is configured so as to be engageable with or by a driving tool, which engagement is operable for moving or rotating the operable element about its axis of rotation.

In one form, the hole has a thread configured for threaded engagement with a threaded portion provided with the shaft portion of the operable element.

In one embodiment, the head portion comprises a recess configured on an exterior facing surface of the head portion, the recess configured for engagement with or by a driving tool, the engagement between the recess and the driving tool configured operable for facilitating transfer of torque generated via the driving tool about the axis of rotation of the operable element thereby causing rotation of the operable element about the axis of rotation.

In one embodiment, a portion of an exterior of the shaft portion of the piston comprises a thread (for example, a male thread) compatible with the thread (for example, a female thread) of the hole so that the operable element can be arranged in threaded engagement with the thread of the hole. In this manner, rotation of the piston about said axis of rotation moves or translates the piston along said axis of rotation.

In one embodiment, threaded engagement between the shaft portion of the piston of the operable element and the hole operably associates the first body with the operable element.

In one embodiment, the operable element comprises or carries an annular flange spaced along the shaft portion from the head portion. In one form, the annular flange positions intermediate the head portion and the threaded portion of the shaft portion. The interconnection between the operable element and the second body for enabling driving movement thereof being established by way of a portion of the annular flange being receivable in the slotted region of the second body.

In one embodiment, the second body comprises an opening extending between first and second oppositely disposed sides of the second body.

In one embodiment, the second body comprises a slotted region intermediate the first and second sides of the second body and which opens to the opening extending between first and second ends of the second body.

In another form, operable association of the first and second bodies via the operable element is by way of the threaded engagement of the hole with the operable element and the interconnection established by way of the receiving of the portion of the annular flange in the slotted region of the second body.

In one embodiment, the opening extending between first and second sides of the second body is configured so as to receive or accommodate a portion of the shaft portion of the piston of the operable element.

In one embodiment, the slotted region is configured so as to receive/accommodate at least one or more portions (eg. one or more shoulder portions of the annular flange) of the annular flange sufficient for capturing the or each portion of the annular flange therein for confirming an interconnection between the second body and the operable element. Engagement of the annular flange with the slotted region in this manner operably associates (via movement/translation of the piston) the operable element with the second body such that movement of the annular flange facilitates movement or driving of the second body on operation of the operable element. In this manner, rotation of the operable element about its axis of rotation causes the annular flange to move or translate along said axis of rotation. The direction of rotation of the operable element about the axis of rotation informs the direction along the axis the annular flange moves or translates (and moves/drives the second body).

In one form, the second body is configured so as to enable the slotted region to receive or accommodate a portion of the shaft portion which comprises or carries the annular flange so as to increase or maximise the portion of same within the slotted region.

In one embodiment, operable association of the first and second bodies via the operable element is by way of the threaded engagement of the hole with the shaft portion of the operable element, and the interconnection established by way of the receiving of the portion(s) of the annular flange in the slotted region of the second body. In this manner, the operable element operably associates the first body with the second body.

In one embodiment, movement or translation of the operable element along the axis about which it rotates (on operation of the operable element) enables the annular flange to push against the second body by way of the interconnection established by way of the receiving of the portion(s) of the annular flange in the slotted region of the second body.

In one embodiment, the second body is configured having one or more portions thereof that interact with or bear against one or more portions of the GET so that it follows or is driven by movement of the second body (for example, by way of the second body pushing against a portion of the GET) in either of the first, second modes of operation in response to operation of the operable element (eg. when caused to be operable about the axis of rotation by way of the drive tool when engaged with the recess of the head portion). In this manner, the second body is affirmatively engaged with at least one portion of the GET. In one form, the second body is positioned relative to the GET so that one or more portions of the second body bear against one or more portions of the GET so as to positively drive or move, or seek to positively drive or move, the GET on operation of the operable element via the driving tool.

In one form, the operable element carries or is operable with one or more annular seal elements arranged concentric with or carried by the shaft portion, the or each seal element positionable relative the shaft portion so as to protect one or more regions of thread or of threaded engagement from ingress of debris during ground engaging operations.

In one embodiment, driving or moving of the GET on operation of the operable element occurs in respect of an axis which is aligned substantially parallel with the first axis in either of first, second directions there along.

In one embodiment, one or more portions of the second body interact with one or more portions of the GET by pushing there against for seeking to move/drive same in substantially the first direction in the first mode of operation of the attachment assembly.

In one embodiment, one or more portions of the second body interact with one or more portions of the GET by pushing there against for seeking to move/drive same in substantially the second direction in the second mode of operation of the attachment assembly.

In the first mode of operation, moving/driving of the GET by the second body in the first direction substantially aligned with the first axis on operation of the operable element about the axis of rotation in a first direction of rotation operates to subject the GET to a force for progressing or converging the GET toward a position in which the GET is held or secured against the wear edge.

In the second mode of operation, moving or driving of the GET by the second body in the second direction substantially aligned with the first axis on operation of the operable element about the axis of rotation in a second direction of rotation, substantially opposite to the first direction of rotation, operates to reduce, disrupt or release a force causing the GET to remain in said position against the wear edge.

In one embodiment, operation of the operable element in the second mode of operation positively moves or drives the GET away from said position in which the GET is held against the wear edge or its distal extent.

In an alternate embodiment, the operable element is rotatably supported in the hole in a manner allowing it freedom to rotate about said axis of rotation, but without freedom to translate along said axis of rotation. In this arrangement, the second body is configured so as to threadedly engage with a portion (eg. a threaded portion of the shaft of the piston) of the operable element such that rotation of the operable element, about its axis of rotation, causes the second body to translate along a portion of the operable element for seeking to increase the spacing between the first, second bodies, or reduce same as required depending on which of the first, second modes is operable.

In one embodiment, the GET comprises a second opening in a side thereof (for example, a side of the GET that is upward facing relative to its installation orientation with the excavator bucket) and through or into which the second body is inserted/placed for positioning relative thereto such that one or more portions of the second body interact with one or more portions of the GET for driving or moving of same in the first, second modes of operation via selective operation of the operable element.

In one embodiment, the GET comprises a second opening in a side thereof and through or into which the second body is insertable/placeable for interconnecting the slotted region with the annular flange and positioning the second body relative to the GET so as to enable said portion(s) of the second body to interact with or bear against said respective corresponding portion(s) of the GET for driving or moving of same in the first, second modes of operation via operation of the operable element.

The assembly may further comprise, or be arranged operable with, a retention means, device, or system (hereinafter, retention means/device) operable between a portion of the second body and a portion of the GET or the operable element for establishing mutual engagement or interaction that is operable for retaining or preserving the position of the second body relative to the GET following insertion/placement of the second body through or into the second opening.

The retention means/device may be attachable with the second body and comprise one or more portions engageable with one or more respective corresponding portions of the GET/shroud by way of, at least in part, a resilient characteristic of the retention means/device following insertion of the second body through or into the second opening into position relative to the GET/shroud (for driving or moving of same).

The retention means/device may be attachable with the GET/shroud and comprise one or more portions engageable with one or more respective corresponding portions of the second body by way of, at least in part, a resilient characteristic of the retention means/device following insertion of the second body through or into the second opening into position relative to the GET/shroud (for driving or moving of same).

The retention means/device may be configured operable between a portion of the second body and a portion of the operable element for establishing an engagement or interaction between both that is operable for retaining or preserving the position of the second body relative to the GET following insertion of the second body through or into the second opening into position relative to the GET/shroud (for driving or moving of same).

The retention means or device may comprise:

(i) a metallic material, or (ii) an elastomeric material, or (iii) a combination of both a metallic material and an elastomeric material.

For the case where one or more portions or components of the retention means/device comprises, either individually or in combination, an elastomeric component (for example, a rubber material, vulcanized or otherwise), the elastomeric portion or component may be configured, whether attached with the second body or the GET/shroud, so as to be sufficiently compressible or elastically deformable so as to allow for insertion of the second body through the second opening into a position relative to the GET/shroud for driving or moving of same, and transitionable to a condition that operates directly or indirectly with the GET/shroud, second body, or the operable element to impede the second body from lifting upwards out of its position relative to the GET/shroud thereby preserving said relative position.

For the case where one or more portions or components of the retention means/device comprises, either individually or in combination, a metallic component, the metallic portion or component may be formed or configured (for example, in a spring-like manner), whether attached with the second body or the GET/shroud, so as to be sufficiently compressible or elastically deformable so as to allow for insertion of the second body through the second opening into a position relative to the GET/shroud for driving or moving of same, and transitionable to a condition that operates directly or indirectly with the GET/shroud, second body, or the operable element to impede the second body from lifting upwards out of its position relative to the GET/shroud thereby preserving said relative position.

The retention means or device may be attachable to either the second body or the GET/shroud by way of any of the following: an adhesive bond, a vulcanisation bonding process.

In one embodiment, a profile or shape of the second opening of the GET is substantially complementary with a profile or shape of at least one side of or aspect of the second body, the complementary nature of the profile/shape of the second opening and the profile/shape of the at least one side or aspect of the second body enabling the second body to be insertable through the second opening for said relative positioning of the second body with the GET thereby operating to establish, at least in part, the affirmative (or positive) interconnection/engagement between both components when the second body is placed within the second opening. In this manner, the second body is able to push against a portion of the GET when the second body is moved/driven by the operable element via the annular flange.

In one embodiment, the GET comprises a third opening in a side thereof configured so as to allow access to the operable element or its head portion for operation thereof via a driving tool.

In one embodiment, the second body comprises one or more further slots formed in respective one or more sides of the second body, the or each slot configured for receiving a portion of a tool for use in removal of the second body (via, for example, the second opening).

In one embodiment, the or each further slots are of finite depth having a respective opening.

In one embodiment, one or more edges of the second opening of the GET are configured or shaped so as to expose, at least in part, one or more of the further slots formed in the sides of the second body when both components are in affirmative engagement.

In one embodiment, the or each edges of the second opening of the GET are configured having a sloped or inclined surf ace (hereinafter, inclined surface(s)) that terminates at or near an opening of one of said further slots when the second body is positioned relative to the GET for operation with the remaining componentry of the attachment assembly in one or both of the first, second modes of operation.

In one embodiment, the or each inclined surface allows access to an adjacently disposed further slot so that a tool (such as for example, a crowbar) can be used to engage the relevant further slot for prising/leveraging of the second body from the second opening of the GET.

In one embodiment, the first, second bodies and the operable element are substantially operable within a profile of the GET.

In one embodiment, at least the first body and the operable element are operable with a channel formed within the GET which opens to adjacent sides of the GET or its body.

In one embodiment, the channel is configured for receiving the boss when the GET is being positioned relative to or in respect of the wear edge for securement thereto. In one form of assembly, at least the first body (which may be assembled with the operable element) is first interconnected with the boss, and the GET fitted in position relative to the wear edge (or its distal extent) for securement. Thus, in at least one embodiment, the channel is configured so as to be substantially parallel with/to a longitudinal extent of the GET and operable for receiving both the boss and the first body when the GET is being positioned relative to the wear edge. The channel may be configured so as to be complementary in shape to the effective shaping/profile of the boss and the first body (either individually, or in combination) when in their affirmative/interconnected engagement such that both can be snugly received and retained in the channel when the GET is in position such that the GET is restricted to move relative to the boss and the first body along a length of the channel. For example, the boss and the first body may be configured having tapering sidewalls (for example, of a 'dove-tail' or 'T' like shape/configuration) so that as the channel slides over the boss and the first body and the GET self-centres and self-aligns with respect to the boss (and the interconnected first body). Such interaction, advantageously, enhances the fit of the GET with respect to the wear edge and or its distal extent.

Of course, embodiments can be realised where the operability described above may only be required in respect of the boss itself, for example, where the first body, while interconnected with the boss, has a smaller profile and does not warrant shaping for interacting with the channel.

When fitting the GET to the wear edge, the channel is positioned relative to the boss and the first body so that the GET can be slidingly received there over, and the wear edge is received in the first opening. The channel may commence a distance from an end of the GET distal of the ground engaging region of the GET, and extend towards said ground engaging region and terminating a distance therefrom.

In one embodiment, the channel opens to the first, second, and third openings of the GET.

In one embodiment, one or more portions of a surface of the boss and/or the first body is/are configured so that interaction with one or more portions of a surface of the GET operates to assist in guiding or converging the GET toward a position in which said GET is held with respect to the wear edge when the operable element is operated in the first mode of operation.

In one embodiment, one or more portions of respective sides of the first body and/or the boss are shaped so as to interact with one or more portions of an interior surface of the channel of the GET, such interaction being configured for, at the least, assisting in guiding or converging of the GET toward a position in which it is held against the wear edge by operation of the attachment assembly in the first mode of operation.

In one embodiment, one or more portions of respective sides of the first body and/or the boss are shaped so as to cooperate by way of interacting with one or more portions of an interior surface of the channel of the GET, such interaction being configured for, at the least, assisting in guiding or converging the GET toward a position in which it is held against the wear edge by operation of the attachment assembly in the first mode of operation.

In one embodiment, said interaction between the or each respective side portion(s) of the first body and/or boss and interior portion(s) of the channel of the GET operate to substantially restrain the GET in the first, second, and third axes relative to the wear edge aid or its distal extent.

In one embodiment, one or more respective sides of the first body are shaped/configured so as to substantially continue the form or profile of the boss for assisting in guiding the GET toward a position in which it is held against the wear edge by operation of the attachment assembly in the first mode of operation.

According to a second aspect, there is provided a ground engaging assembly for use with a leading or wear edge of or associated with earthmoving equipment, the ground engaging assembly comprising:

a ground engaging tool (GET) configured to be received with respect to said edge, the GET configured having a channel for receiving a portion of or in fixed relation with respect to said edge when the GET is being positioned relative to said edge for securement thereto, an attachment assembly for releasably securing the GET with said edge, the attachment assembly comprising:

a first body configured for placement in affirmative engagement with said portion of or in fixed relation with respect to said edge;

a second body configured for placement in affirmative engagement with a portion of the GET;

an operable element operably associating the first and second bodies so as to be responsive to operation of the operable element in a mode in which one of said bodies is moved or driven away from the alternate body, the separation of the bodies operating to apply a force to said portion of the GET for holding the GET with respect to said edge, and in a further mode in which one of said bodies is moved or driven toward the alternate body for removal of the GET.

According to a third aspect, there is provided aground engaging assembly for use with a leading or wear edge of or associated with earthmoving machinery, the ground engaging assembly comprising:

a member associable at or near said edge so as to be in fixed relation therewith, a ground engaging tool (GET) configured to be received with respect to said edge, the GET configured having a channel for receiving said member when the GET is being positioned relative to said edge for securement thereto, an attachment assembly for releasably securing the GET with said edge, the attachment assembly comprising:

a first body configured for placement in affirmative engagement with said member;

a second body configured for placement in affirmative engagement with a portion of the GET;

an operable element operably associating the first and second bodies so as to be responsive to operation of the operable element in a mode in which one of said bodies is moved or driven away from the alternate body, the separation of the bodies operating to apply a force to said portion of the GET for holding the GET with respect to said edge, and in a further mode in which one of said bodies is moved or driven toward the alternate body for removal of the GET.

According to a fourth aspect, there is provided a method of attaching a ground engaging tool (GET) with a leading or wear edge of or associated with earthmoving equipment, the method comprising:

forming, providing or configuring a GET so as to be receivable with respect to said edge, the GET configured having a channel for receiving a portion of or in fixed relation with respect to said edge when the GET is being positioned relative to said edge for securement thereto, forming, providing or configuring an attachment assembly for releasably securing the GET with said edge, the attachment assembly comprising:

a first body configured for placement in affirmative engagement with said portion of or in fixed relation with respect to said edge;

a second body configured for placement in affirmative engagement with a portion of the GET;

an operable element operably associating the first and second bodies so as to be responsive to operation of the operable element in a mode in which one of said bodies is moved or driven away from the alternate body, arranging the first body in operable association with the operable element, and in affirmative engagement with said portion of or in fixed relation with respect to said edge, arranging the second body in operable association with the operable element, and in affirmative engagement with said portion of the GET, operating the operable element so as to separate the bodies for applying a force to the GET for holding same with respect to said edge.

According to a fifth aspect, there is provided a method of releasing a ground engaging tool (GET) secured with a leading or wear edge of or associated with earthmoving equipment by way of a force being applied to the GET by way of an attachment assembly comprising a first body in affirmative engagement with respect to said edge, a second body in affirmative engagement with the GET, and an operable element operably associating the first and second bodies so as to be in spaced or separated relation for providing said force, the method comprising operating the operable element so as to reduce said spaced or separated relation of the bodies for reducing said force for removal of the GET.

In one embodiment, the operable element and the first, second bodies are components of an embodiment of an attachment assembly according substantially with the attachment assembly of the first aspect, or as otherwise described herein.

According to a sixth aspect, there is provided a method of forming or configuring an embodiment of an attachment assembly as described herein.

According to a seventh aspect, there is provided a method of forming or configuring an embodiment of aground engaging assembly as described herein According to an eighth aspect, there is provided a method of using an embodiment of an attachment assembly as described herein for releasably securing aground engaging tool with earthmoving equipment, and or removing a ground engaging tool from earthmoving equipment.

According to a further aspect, there is provided an attachment assembly for releasably securing aground engaging tool (GET) with earthmoving equipment, the attachment assembly comprising:

a first body configured for placement in affirmative engagement with a portion of or in fixed relation with respect to an edge of or associated with the earth moving equipment;

a second body configured for placement in affirmative engagement with a portion of the GET;

an operable element operably associating the first and second bodies so as to be responsive to operation of the operable element in:

a first mode in which the second body is driven away from the first body on the GET being received with respect to said edge, the separation of the bodies operating to apply a force to said portion of the GET for holding the GET with respect to said edge, and a second mode in which the second body is moved or driven toward the first body thereby releasing said force for removal of the GET, wherein the second body comprises a slotted region configured so as to receive a portion of or carried by the operable element for forming an interconnection therebetween for enabling driving movement of the second body via operation of the operable element in the first and second modes.

According to another aspect, there is provided a method of attaching a ground engaging tool (GET) with a leading or wear edge of or associated with earthmoving equipment, the method comprising:

forming, providing or configuring an attachment assembly in accordance with any embodiment of an attachment assembly as described herein for releasably securing the GET with said edge, arranging the first body in operable association with the operable element, and in affirmative engagement with said portion of or in fixed relation with respect to said edge, positioning the GET in respect of said edge such that a portion thereof receives said portion of or in fixed relation to said edge, arranging the second body in operable association with the operable element and in affirmative engagement with said portion of the GET, operating the operable element so as to separate the bodies for applying a force to the GET for holding same with respect to said edge.

According to a further aspect, there is provided a ground engaging system or tool operably configured in accordance with any embodiment of a ground engaging assembly or ground engaging tool described herein.

According to another aspect, there is provided an excavator bucket or wear like component of an earthmoving equipment/vehicle having, or configured for operable use with, an embodiment of an attachment assembly, a ground engaging system or assembly, or a ground engaging tool arranged in accordance with any embodiment of an attachment assembly, a ground engaging system or assembly, or a ground engaging tool as described herein.

According to a further aspect, there is provided an earthmoving equipment/vehicle having, or configured for operable use with, an embodiment of a ground engaging assembly arranged in accordance with the ground engaging assembly as described herein.

According to a further aspect, there is provided a kit of parts comprising any of the components of any embodiment of the attachment assembly as described herein, either individually or in combination.

In one form, the kit comprises an embodiment of a boss as described herein for attachment to at or near a leading or wear edge of an earthmoving equipment/vehicle.

According to another aspect, there is provided a kit of parts comprising any of the components of an embodiment of a ground engaging system, related assembly, or related tool arranged in accordance with the ground engaging system, related assembly, or related tool as described herein, either individually or in combination.

Embodiments of the attachment assembly described herein may provide any of the following advantages:

a simplified 'vice' like attachment assembly (one fixed body/jaw captured in a boss associated with the bucket of the earth moving equipment, and one movable body/jaw traversably captured in the shroud or body of the GET) that can be used to facilitate both retightening of the GET on or in respect of the leading or wear edge, as well as helping expel it once worn for replacement purposes;

an attachment assembly that combines the utility of the interaction between a boss and the GET which helps limit the stresses induced on the components of the attachment assembly, with the utility of a thread type locking/retention system. In some instances, a means, device, or arrangement for preventing or at least limiting turning of such systems (eg. an anti-turn means or element) may be employed for redundancy measures; for example a means, device, or arrangement can be configured operable with the thread of the threaded portion of the operable element so as to cooperate with the thread so as to seek to reduce, to the extent possible, any "play" that might develop between the operable element and the hole (blind or otherwise) when operable. In this regard, such cooperability operates, at least in part, as a means of conferring/facilitating additional friction for keeping the operable element in its intended position and limit its tendency to work itself free (due to any "backlash" that might be experienced) during on-going loading cycles during ground engaging operations;

enhanced protection of the attachment assembly from wear and fines as compared existing solutions;

easy/convenient visualisation and accessibility of the moving body/jaw to permit easy and safe installation and removal of the shroud or body of the GET;

one or more failsafe release points should the thread of the lock seize up making extraction difficult/stubborn. In this manner, access is provided at about the region where the second body inserts via the second opening so that, in the event that, for example, the thread of the operable element seizes up making a removal operation more challenging/difficult, access is provided/enabled for allowing a cutting means (such as for example, a grinding blade or oxy gas torch flame) to be used to severe the shaft of the operable element for facilitating easier removal of the operable element and the second body from within the shroud or body of the GET, for example, the cutting/severing process resulting in a portion of the length (eg. about 3-5 mm) of the operable element (eg. its shaft portion) being eliminated so as to generate enough clearance or play so that both the operable element and the second body can be manipulated from within the confines of the body or shroud of the GET;

simplified manufacturing of components of the attachment assembly, as a whole, when compared to existing attachment/locking systems;

simplified core boxes for castings, reduced number and intricacy of locking components.

Various aspects described herein can be practiced alone or combination with one or more of the other aspects, as will be readily appreciated by those skilled in the relevant art. The various aspects can optionally be provided in combination with one or more of the optional features described in relation to the other aspects. Furthermore, optional features described in relation to one example (or embodiment) can optionally be combined alone or together with other features in different examples or embodiments.

For the purposes of summarising the aspects, certain aspects, advantages and novel features have been described herein above. It is to be understood, however, that not necessarily all such advantages may be achieved in accordance with any particular embodiment or carried out in a manner that achieves or optimises one advantage or group of advantages as taught herein without necessarily achieving other advantages as may be taught or suggested herein.

It is to be understood that each document, reference, patent application or patent cited in this text is expressly incorporated herein in their entirety by reference, which means that it should be read and considered by the reader as part of this text. That the document, reference, patent application, or patent cited in this text is not repeated herein is merely for reasons of conciseness.

Furthermore, in this specification, where a literary work, act or item of knowledge (or combinations thereof), is discussed, such reference is not an acknowledgment or admission that any of the information referred to formed part of the common general knowledge as at the priority date of the application. Such information is included only for the purposes of providing context for facilitating an understanding of the inventive concept/principles and the various forms or embodiments in which those inventive concept/principles is/are exemplified.

SUMMARY OF DRAWINGS

In order to provide a better understanding of the present invention, a preferred embodiment will now be described in detail, by way of example only, with reference to the accompanying drawings.

Figure 1:
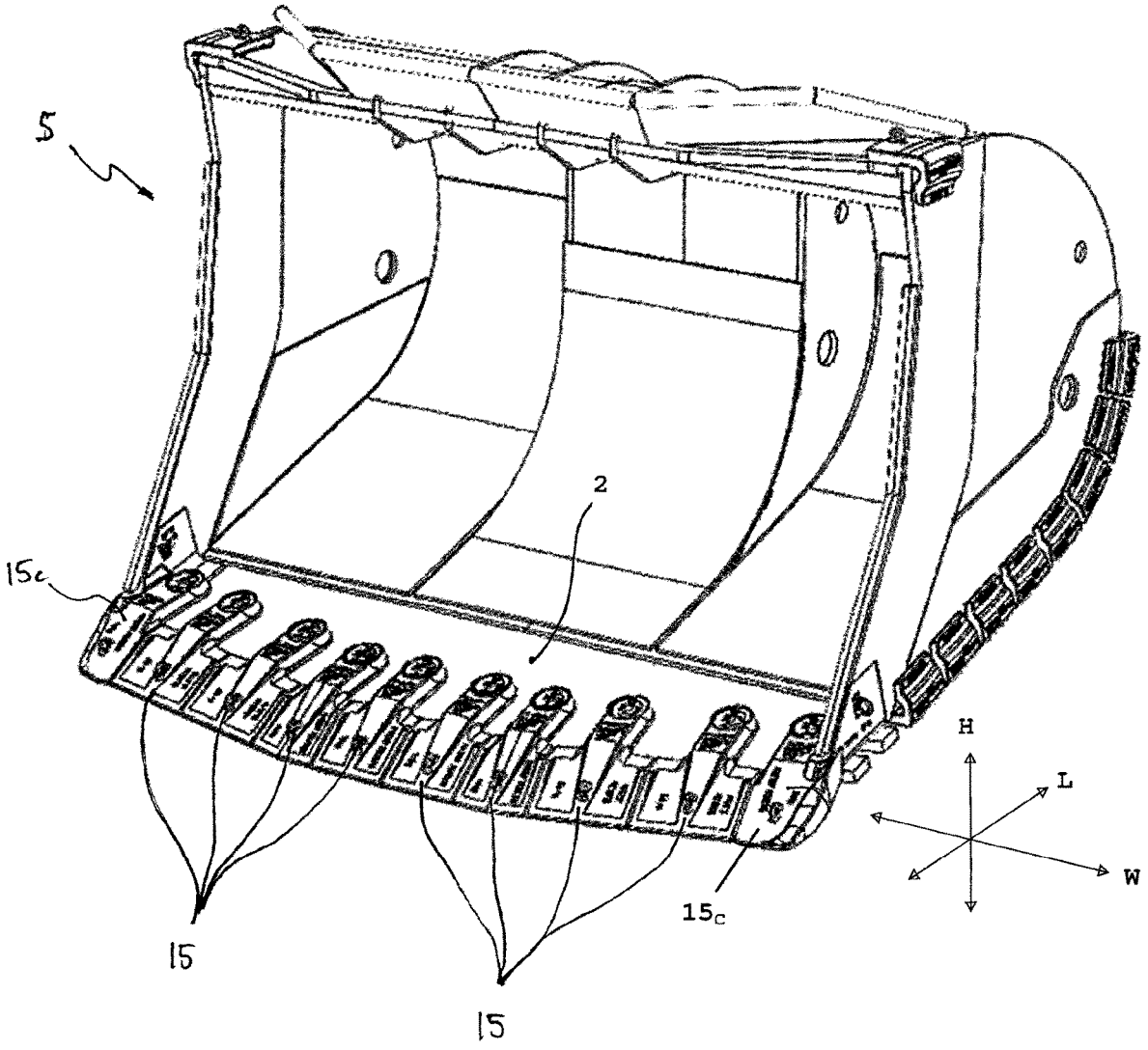
FIG. 1 shows a perspective view of a bucket of an earth moving equipment/vehicle having a plurality of ground engaging tools (GETS) connected at/near its lower (leading) edge.

In the figures, like elements are referred to by like numerals throughout the views provided. The skilled reader will appreciate that elements in the figures are illustrated for simplicity and clarity and have not necessarily been drawn to scale. For example, the dimensions and/or relative positioning of some of the elements in the figures may be exaggerated relative to other elements to facilitate an understanding of the various embodiments exemplifying the principles described herein. Also, common but well understood elements that are useful or necessary in a commercially feasible embodiment are often not depicted in order to provide a less obstructed view of these various embodiments. It will also be understood that the terms and expressions used herein adopt the ordinary meaning as is accorded to such terms and expressions with respect to their corresponding respective areas of inquiry and study except where specific meanings have otherwise been set forth herein.

It should be noted that the figures are schematic only and the location and disposition of the components can vary according to the particular arrangements of the embodiment(s) as well as of the particular applications of such embodiment(s).

Specifically, reference to positional descriptions, such as 'lower' and 'upper', and associated forms such as 'uppermost' and 'lowermost', are to be taken in context of the embodiments shown in the figures, and are not to be taken as limiting the scope of the principles described herein to the literal interpretation of the term, but rather as would be understood by the skilled reader.

Embodiments described herein may include one or more range of values (eg. size, displacement and field strength etc). A range of values will be understood to include all values within the range, including the values defining the range, and values adjacent to the range which lead to the same or substantially the same outcome as the values immediately adjacent to that value which defines the boundary to the range.

Other definitions for selected terms used herein may be found within the detailed description and apply throughout. Unless otherwise defined, all other scientific and technical terms used herein have the same meaning as commonly understood to one of ordinary skill in the art to which the embodiment(s) relate.

DETAILED DESCRIPTION OF EMBODIMENTS

The words used in the specification are words of description rather than limitation, and it is to be understood that various changes may be made without departing from the spirit and scope of any aspect of the invention. Those skilled in the art will readily appreciate that a wide variety of modifications, alterations, and combinations can be made with respect to the above described embodiments without departing from the spirit and scope of any aspect of the invention, and that such modifications, alterations, and combinations are to be viewed as falling within the ambit of the inventive concept.

Throughout the specification and the claims that follow, unless the context requires otherwise, the word "comprise" or variations such as "comprises" or "comprising", will be understood to imply the inclusion of a stated integer or group of integers but not the exclusion of any other integer or group of integers.

Furthermore, throughout the specification and the claims that follow, unless the context requires otherwise, the word "include" or variations such as "includes" or "including", will be understood to imply the inclusion of a stated integer or group of integers but not the exclusion of any other integer or group of integers.

FIG. 1 shows a lip portion or component 2 (hereinafter, lip portion) of an excavator bucket 5 of an instance of an earthmoving equipment/vehicle (not shown in the figures). The lip portion 2 may comprise, for example, of a configuration of one or more plate and/or cast weld-on lip segments formed for use with various types of excavator buckets used in various forms of ground engaging operations. As better seen in FIG. 2, the lip portion 2 comprises a leading or wear edge portion (hereinafter, edge portion 10) to which a plurality of ground engaging tools (GETs) (collectively, 15) are connected by way of being held against a landing face 11 and the edge portion (the landing face 11 being a distal extent of the lip portion 2 following a tapered transition thereto). FIG. 1 shows a version of a GET configured for attachment between the corners of the edge portion 10, and a version of a GET $\mathbf{15}_C$ which is configured for attachment at respective corner regions of the edge portion.

Figure 2:
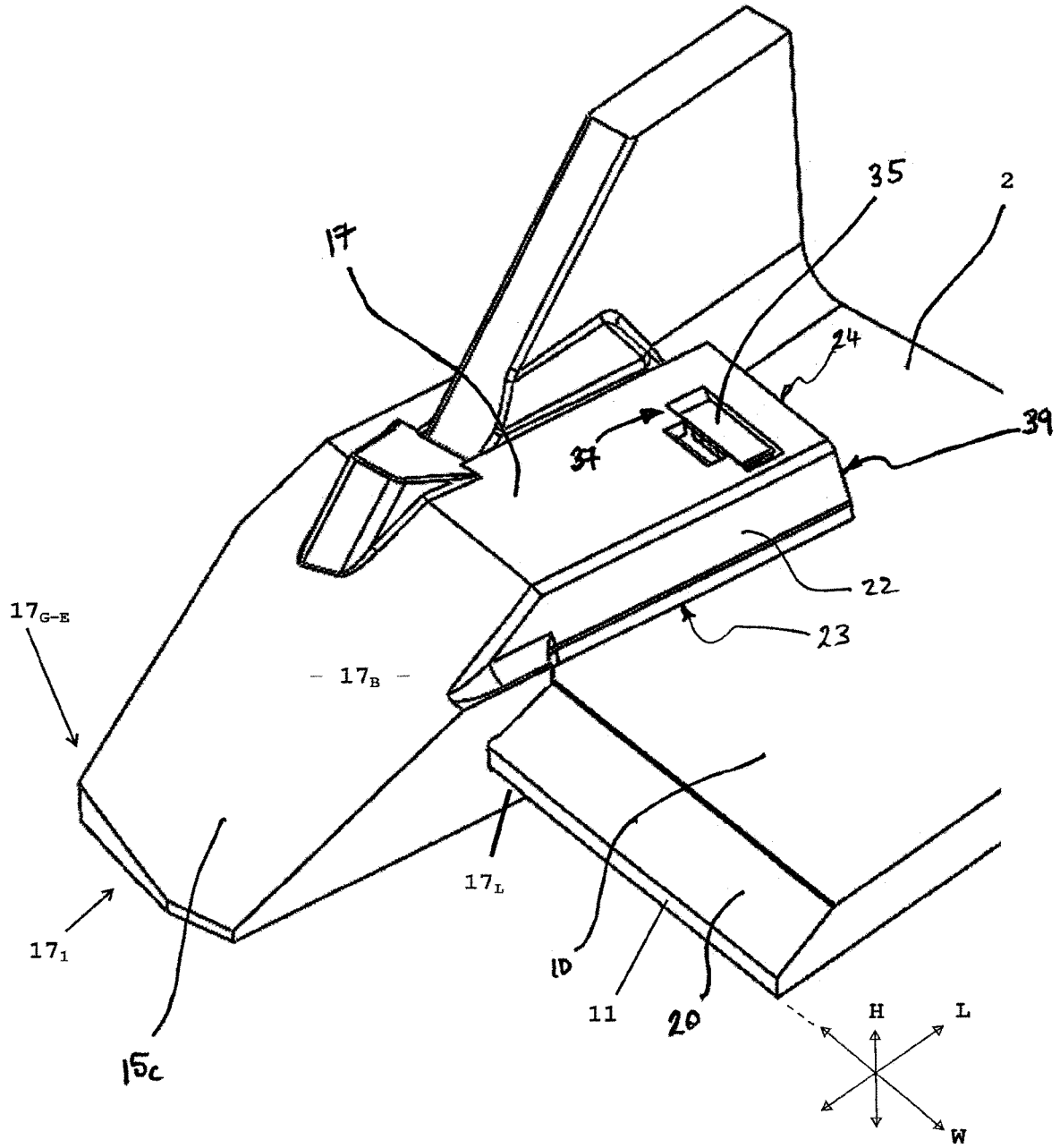
FIG. 2 shows a perspective view of a corner region of an edge of a bucket of an earth moving equipment/vehicle, to which is provided a GET (one suited for placement at/about a corner region of the edge) retained in position using one embodiment of an attachment assembly arranged in accordance with the principles described herein.

FIGS. 2 to 15 show one embodiment of an attachment assembly 25 used, in one form, in a GET assembly for releasably attaching a GET $\mathbf{15}_C$ to the edge portion 10. FIG. 2 shows the GET $\mathbf{15}_C$ (with the alternate configuration of the GETs 15 omitted for clarity) secured in position against the edge portion 10 following operation of the attachment assembly 25.

As the skilled reader will appreciate, the form of the GETs 15 shown throughout the accompanying figures comprise respective shrouds 17. However, other forms of GETs used for mining operations may not comprise a shroud, and may instead comprise a substantially equivalent component that can still benefit from the principles described herein, or be configured so as to operate with them. Thus, the present description, and the principles outlined herein, is/are not to be limited to their use or application to GETs as shown and described herein but can be applied for use by any form of GET requiring removable attachment to an overarching ground engaging device or mechanism.

The shroud 17 comprises a body having a ground engaging region $\mathbf{17}_{G\text{-}E}$ at a first end $\mathbf{17}_1$ of the body $\mathbf{17}_B$. The shroud 17 comprises a leg portion $\mathbf{17}_L$ which extends away from the first end $\mathbf{17}_1$ of the body $\mathbf{17}_B$ and which is spaced from the body so as to define a first opening 78 configured for snugly receiving a portion of the edge portion 10 during fitment of the shroud 17 prior to operating of the attachment assembly 25 in the first mode of operation for holding/securing the shroud 17 against the edge portion 10.

Figure 3:
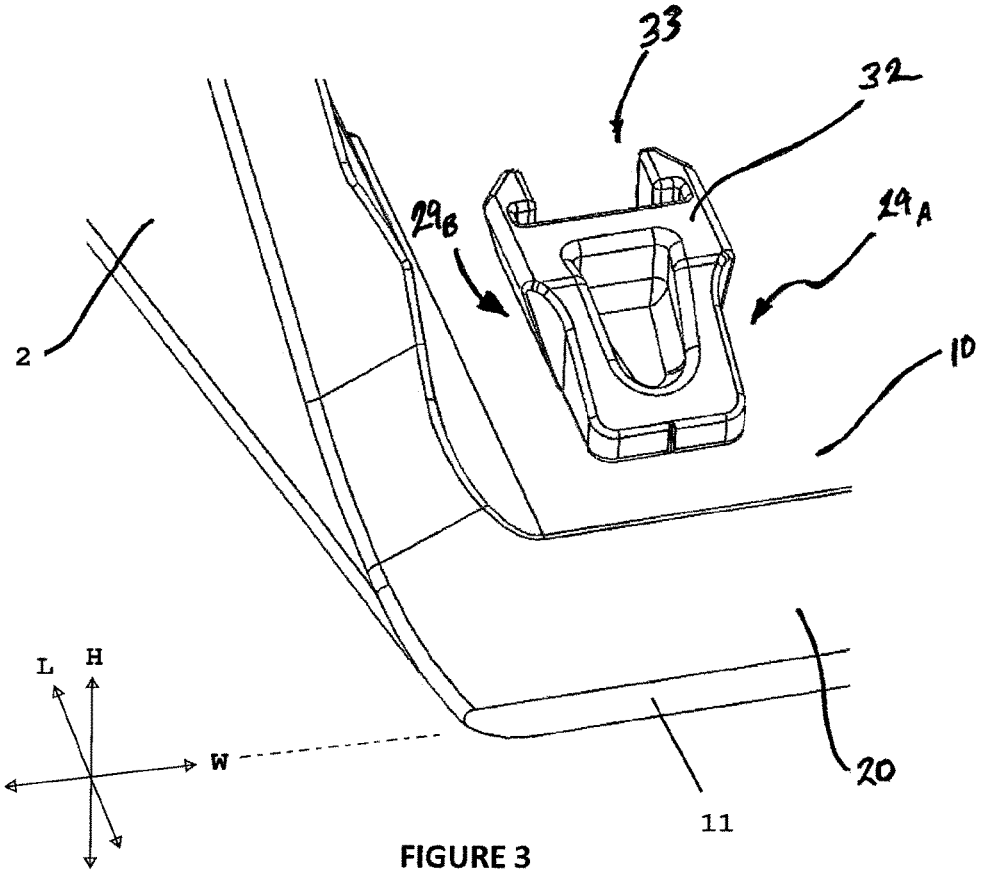
FIG. 3 shows a further perspective view of that shown in FIG. 2, with the GET and attachment assembly removed.
Figure 4:
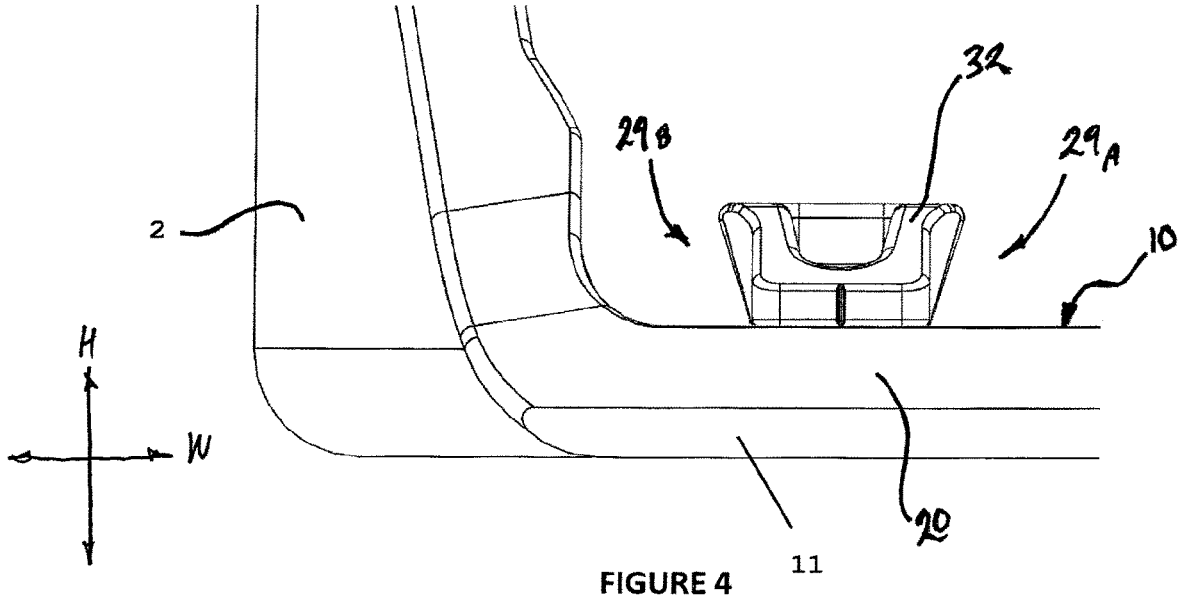
FIG. 4 shows an end view of that shown in FIG. 3.

The attachment assembly 25 comprises a first body (hereinafter, fixed jaw 30) configured for being placed in affirmative or positive engagement with a boss 32 which is attached usually by way of a suitable welding process with the edge portion 10 (as shown in FIGS. 3 and 4) of the earthmoving machine. As the skilled reader will appreciate, a plurality of bosses 32 are provided spaced from each other along the edge portion 10 of the bucket 5, with each used in the connection of a respective GET with the bucket (only one boss 32 is shown in the Figures for clarity of explanation).

As clearly seen in FIGS. 3 and 4, the boss 32 is configured having a shaped exterior providing corresponding tapering or 'dovetail' shaped sides/shoulders $\mathbf{29}_A$, $\mathbf{29}_B$ which engage with corresponding interior surface portions of a channel 38 (which is shown in a cross-section view in FIG. 14) formed with the shroud 17 of the GET $\mathbf{15}_C$. The channel 38 is formed in a portion 22 with positions adjacent the upper facing surface of the edge portion 10 of the bucket 5, and which opens to adjacently disposed sides 23 (eg. underside side, more clearly seen in FIG. 10), 24 (trailing or rearward side) of the shroud 17.

Figure 10:
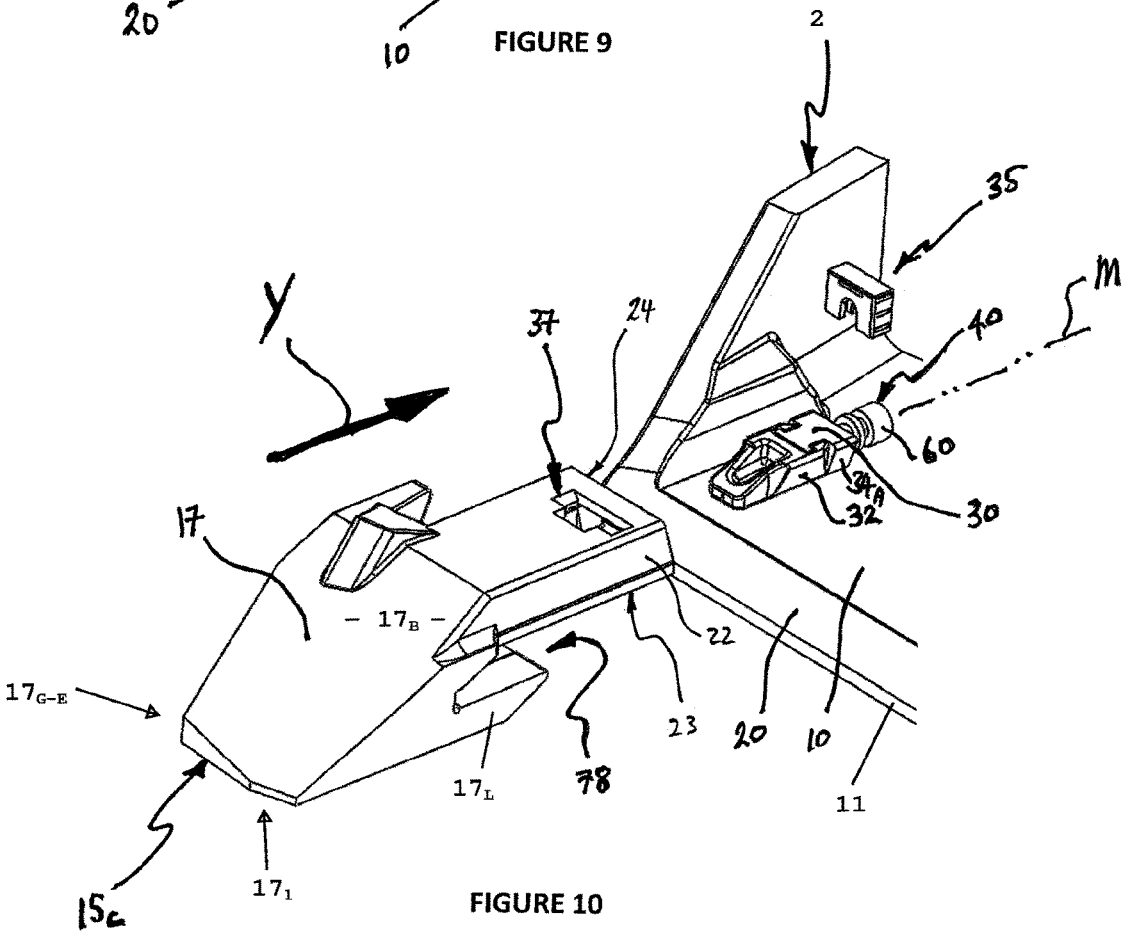
FIG. 10 shows an alternate perspective view with the GET about to be secured with the bucket of the earth moving equipment/vehicle.

The shroud 17 of the GET $\mathbf{15}_C$ comprises an opening 78 (as shown in FIG. 10) which is configured to receive the edge portion 10 of the bucket 5 during assembly of the GET $\mathbf{15}_C$ with the bucket. Receiving of the edge portion 10 in the opening 78 serves to place the shroud 17 and the bucket in an abutting relationship when the GET $\mathbf{15}_C$ is to be attached therewith.

Figure 5:
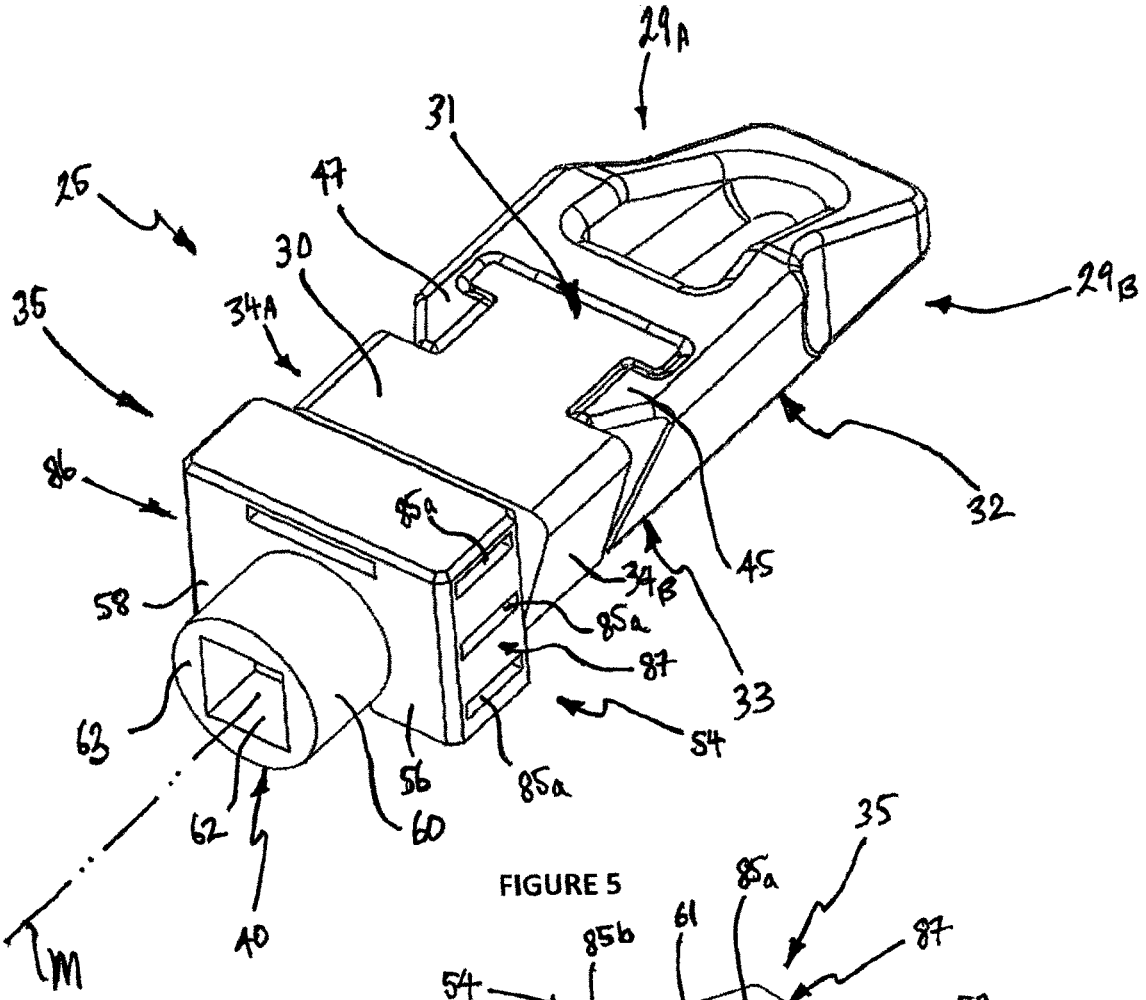
FIG. 5 shows a perspective view of the embodiment of the attachment assembly shown in FIGS. 2 to 4, with the GET and bucket removed.

As seen in FIG. 5, the fixed jaw 30 is placed in affirmative engagement with the boss 32 by way of an end 31 of the fixed jaw 30 being shaped/configured so as to interconnect with an end 33 of the boss 32. As seen clearly in FIGS. 5, 6, 7, and 8, the fixed jaw 30 is substantially 'H' shaped, whereby the end 31 is substantially 'T' shaped so as to slot into position with arm portions 45, 47 (see FIG. 5) provided at the end 33 of the boss 32. As the skilled reader would appreciate, the interconnection of the fixed jaw 30 with the boss 32 serves to fix the fixed jaw 30 relative to the edge portion 10 of the bucket 5 (and, indeed, the landing face 11) in three orthogonally aligned freedoms of movement: axis L (longitudinal axis relative to the earthmoving equipment/vehicle), axis W (width axis relative to the earthmoving equipment/vehicle), and axis H (height axis relative to the earthmoving equipment/vehicle), as shown in FIG. 1. For the present description, the axis W aligns substantially with the landing face 11 (as shown in FIGS. 1-4) thereby defining the origin of the axes L and H, with axis L increasing toward the interior region of the bucket 5, and height H increasing vertically in the usual manner.

The skilled reader will readily appreciate that the ends 31, 33 of the respective fixed jaw 30 and boss 32 could be configured in various manners that would allow interacting portions of both the fixed jaw 30 and the boss 32 to be interconnectable with one another for establishing the required constraint for the fixed jaw 30.

Figure 7A:
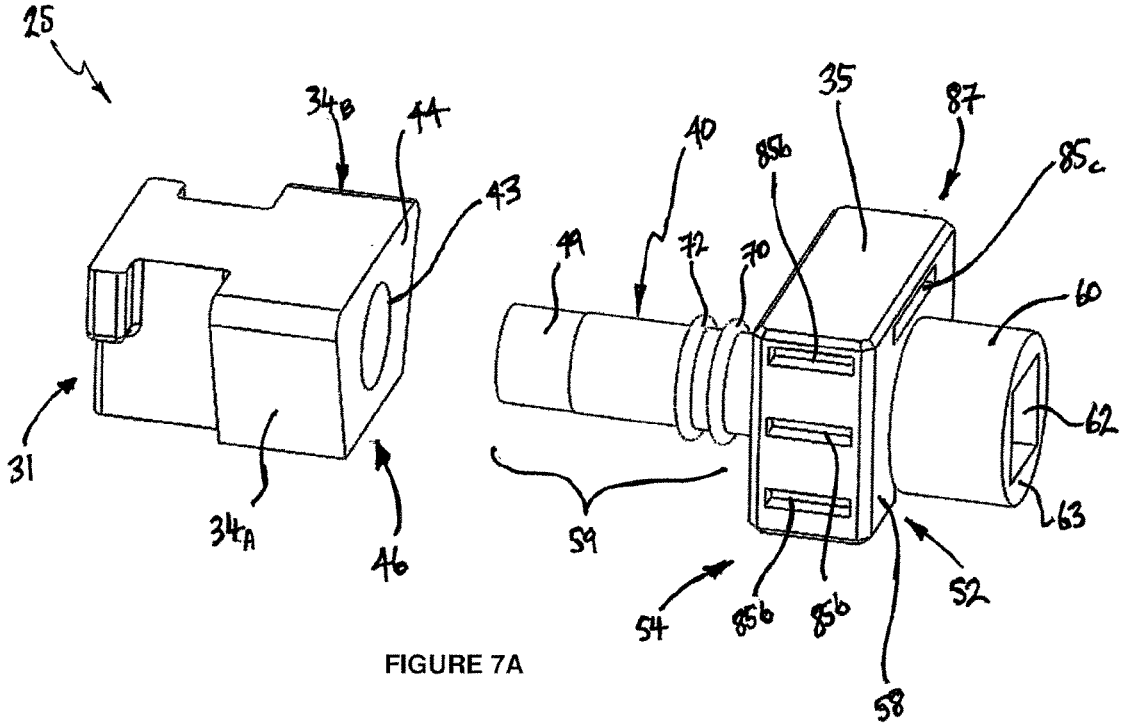
FIG. 7A shows a part exploded perspective view of that shown in FIG. 6.

The fixed jaw 30 comprises a blind hole 43 formed in a face 44 provided at a terminal end 46 of the fixed jaw, as shown in FIG. 7A. A portion of the interior surface of the blind hole 43 (at or near the inward most end of the blind hole) is provided with a thread (a female thread for the embodiment described) that is threadedly engageable with a thread provided on a portion of the operable element 40 (a male thread for the embodiment described). It will be appreciated that the blind hole 43 need not be blind, but could extend through the fixed jaw 30 if required. Thus, while a blind hole (43) is used in the embodiment described herein, the skilled reader will appreciate that all that is required is a circular recess extending into the fixed jaw 30 and configured capable of carrying a thread that is engageable with a corresponding thread provided on a portion 49 of the exterior surface of the shaft portion 59 of the operable element 40, as will be described below.

The attachment assembly 25 further comprises a second body (hereinafter, moveable jaw 35) configured for being placed in affirmative or positive engagement with a portion of the GET $\mathbf{15}_C$.

Figure 12:
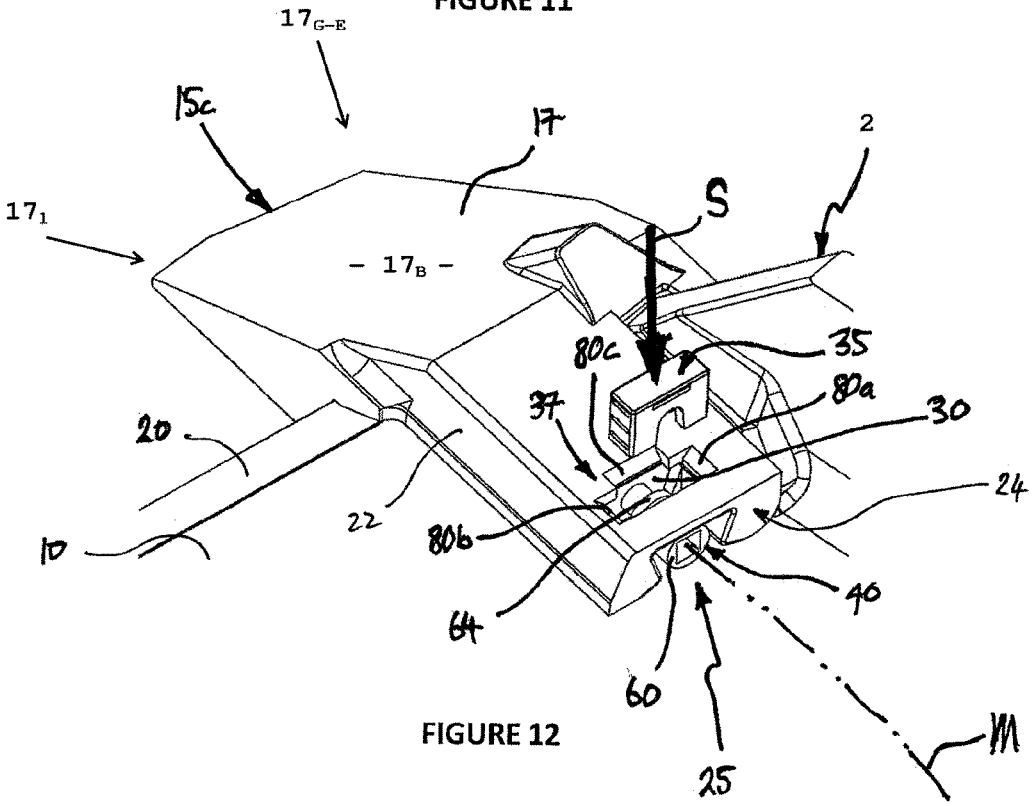
FIG. 12 shows an advancement of that shown in FIG. 11 in the process of securing the GET with the bucket of the earth moving equipment/vehicle.
Figure 13:
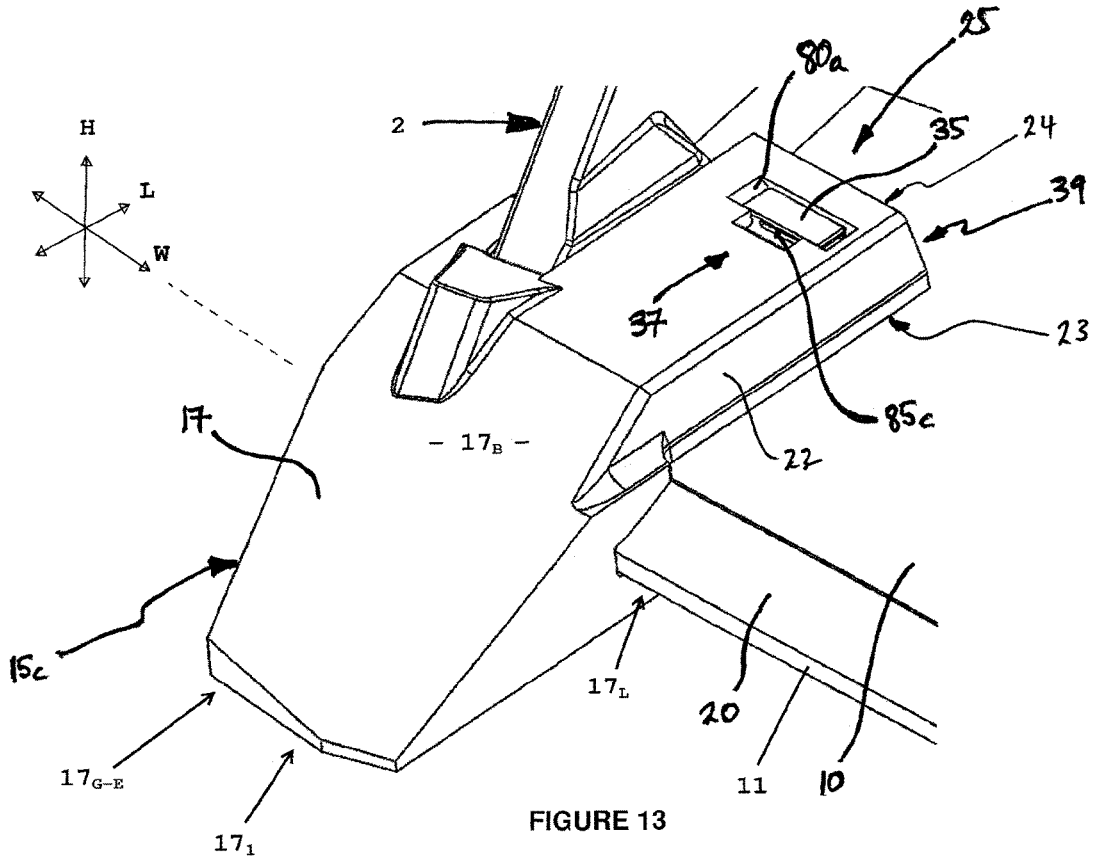
FIG. 13 shows an advancement of that shown in FIG. 12 in the process of securing the GET with the bucket of the earth moving equipment/vehicle.
Figure 15:
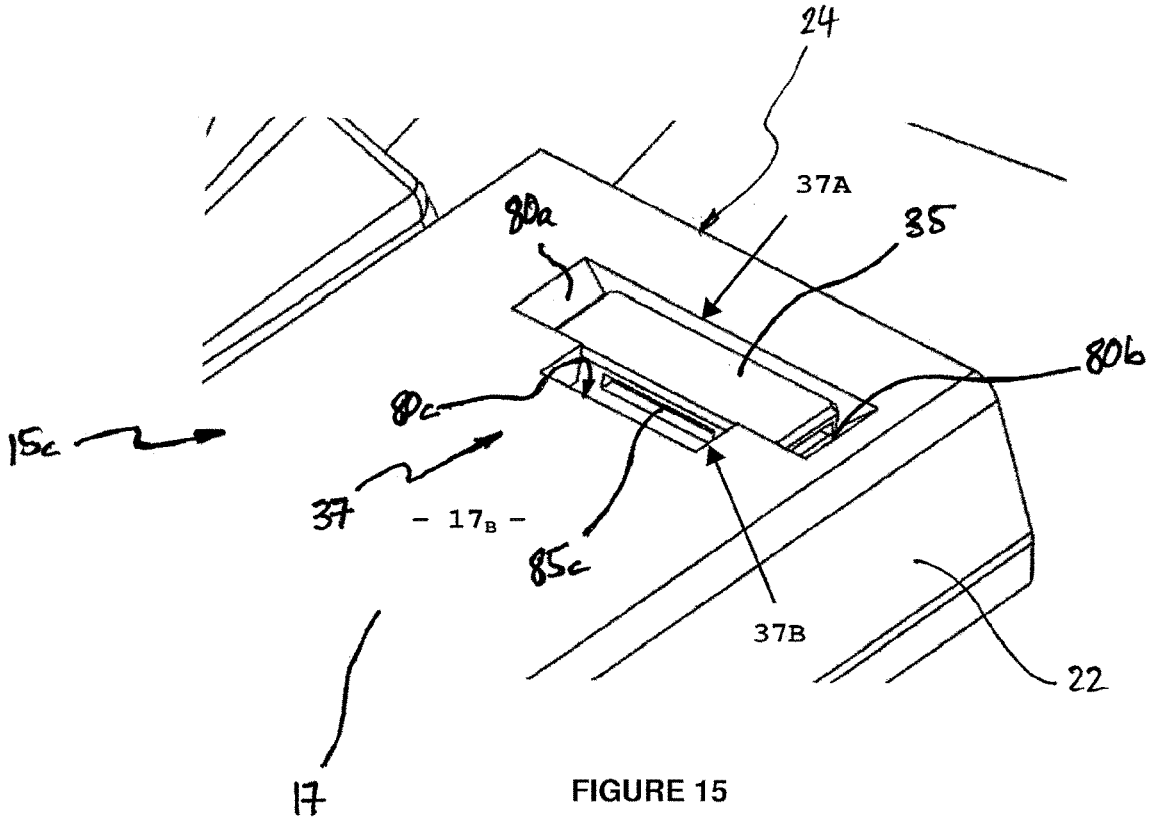
FIG. 15 shows a further close up perspective view of the GET secured in position.
Figure 28:
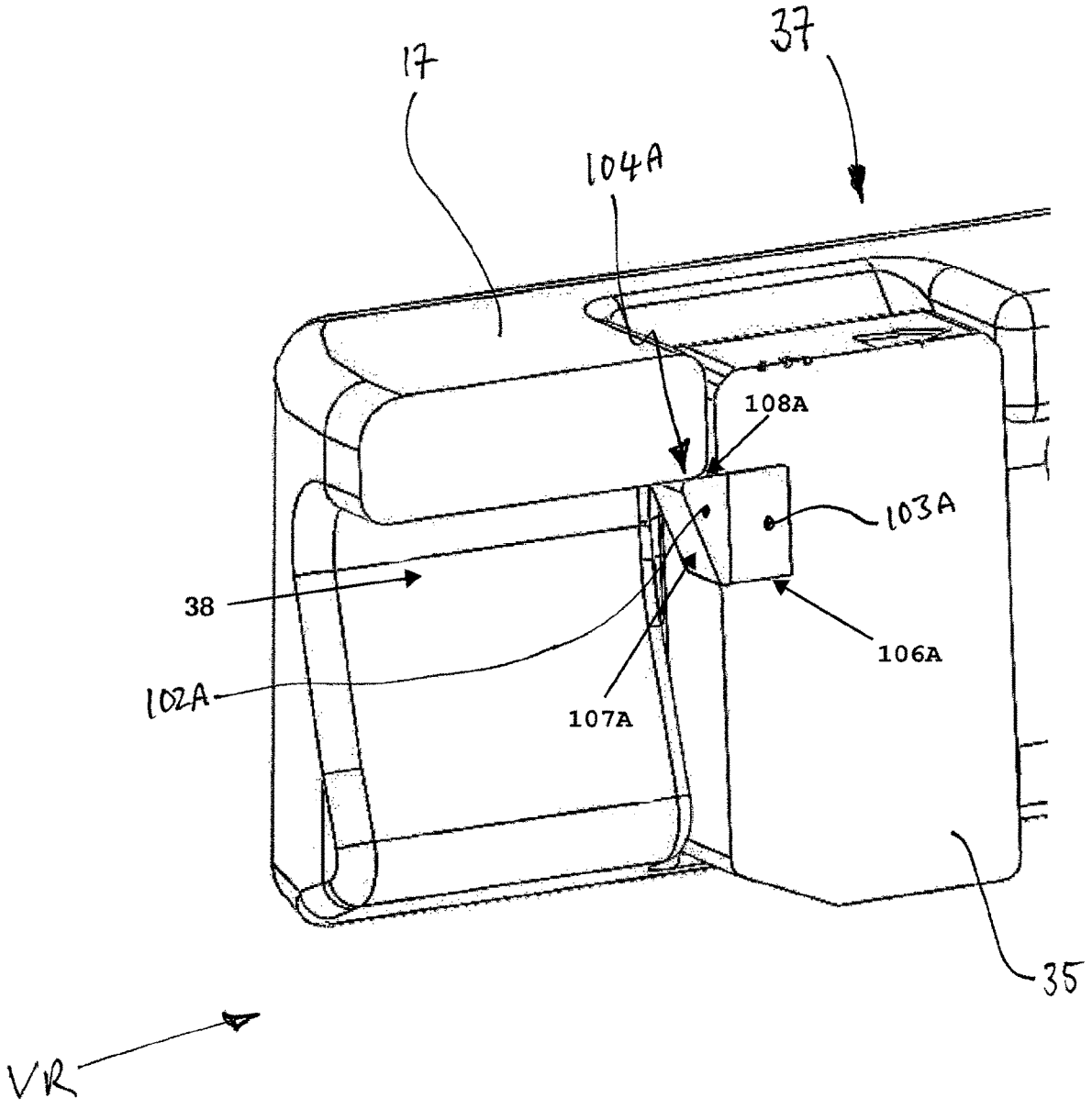
FIG. 28 shows a cut-away perspective view of region A1 shown in FIG. 27, showing an example of an engagement between a retaining element carried by the moveable jaw (35) and a portion of the interior surface of the shroud (17)

The moveable jaw 35 is configured so as to slot into an upper opening 37 (comprising a large size rectangular space 37A and a smaller sized rectangular space 37B—better seen in FIGS. 15 and 28) which opens to the channel 38 that is formed near an end 39 of the shroud 17 (the placement of the moveable jaw 35 into the upper opening 37 is shown in FIGS. 12 and 13, with the moveable jaw moveable in direction S so as to slot in position within the upper opening 37). The moveable jaw 35 is configured having a general rectangular profile which is complementary with the profile of the upper opening 37 so that the moveable jaw 35 can be received in the upper opening such that portions of the shroud 17 (which, in part, define the upper opening 37) and the moveable jaw 35 interact with one another for facilitating the affirmative engagement between the moveable jaw 35 and the shroud 17. The interaction between the moveable jaw 35 and the shroud 17 applies a force (by the moveable jaw 35 pushing against the shroud 17) to the shroud by movement of the moveable jaw 35 seeking to move or drive the shroud in the direction of the applied force along the axis M (ie. increasing in axis L relative to the landing face 11).

Of course, as noted above with regard to the interconnection between the fixed jaw 30 and the boss 32, respective interacting portions can be shaped/configured in various manners that would allow both components to be interconnectable with one another.

Figure 6:
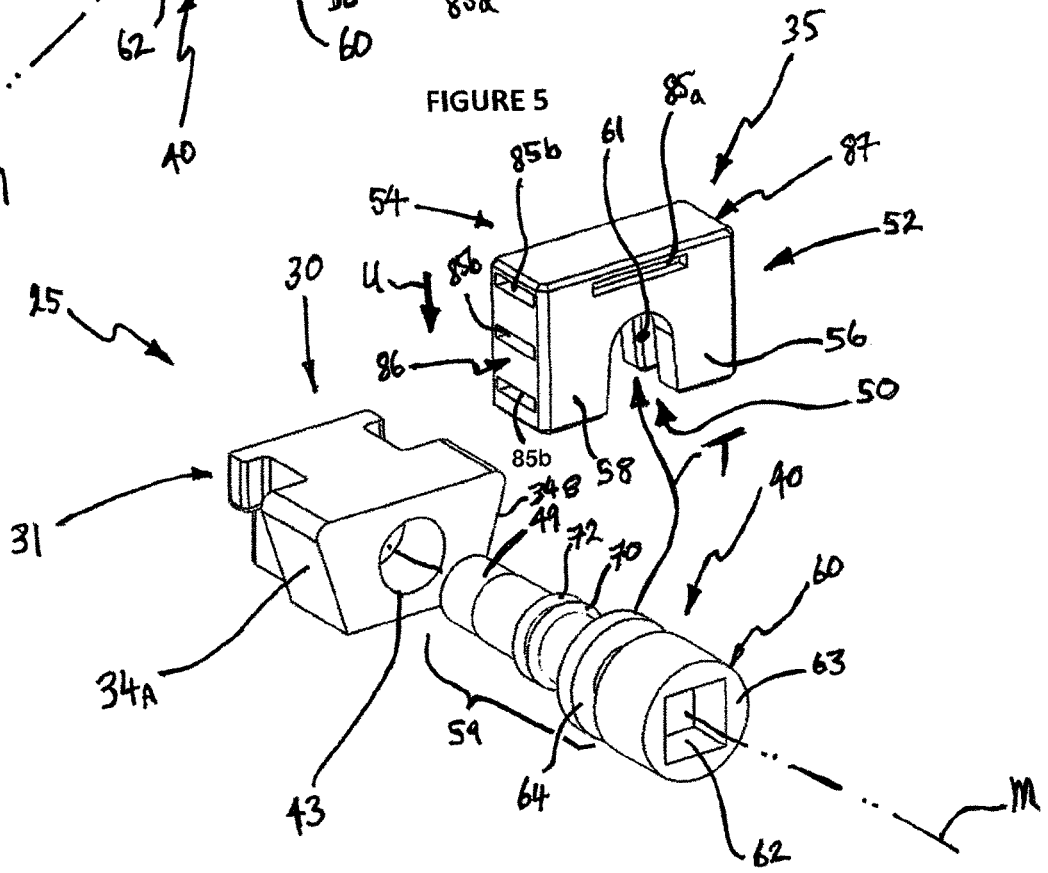
FIG. 6 shows an exploded perspective view of that shown in FIG. 5.

With reference to FIGS. 6 and 7A, the operable element 40 is generally of a piston like form, and rotatable and translatable about/along an axis M.

The piston like form of the operable element 40 comprises a shaft portion 59 extending from a head portion 60. The head portion 60 provides a recess (hereinafter, drive cavity 62) of polygonal form (eg. square shaping shown) formed within an end face 63. Spaced inward of the head portion 60 and extending radially from the shaft portion 59 is an annular flange 64 which is configured of sufficient form so as to be received within a slotted region (the slot 61, as described below) formed in the moveable jaw 35 when the moveable jaw is inserted into the upper opening 37 of the shroud 17. The engagement between the slot 61 and the annular flange 64 establishes affirmative engagement between the operable element 40 and the moveable jaw 35 (in the manner shown in FIG. 7A), as will be described below.

A portion 49 of the exterior surface of the shaft portion 59 of the operable element 40 is provided with a male thread which is formed so as to be threadedly engageable with the female thread of the blind hole 43.

Figure 14:
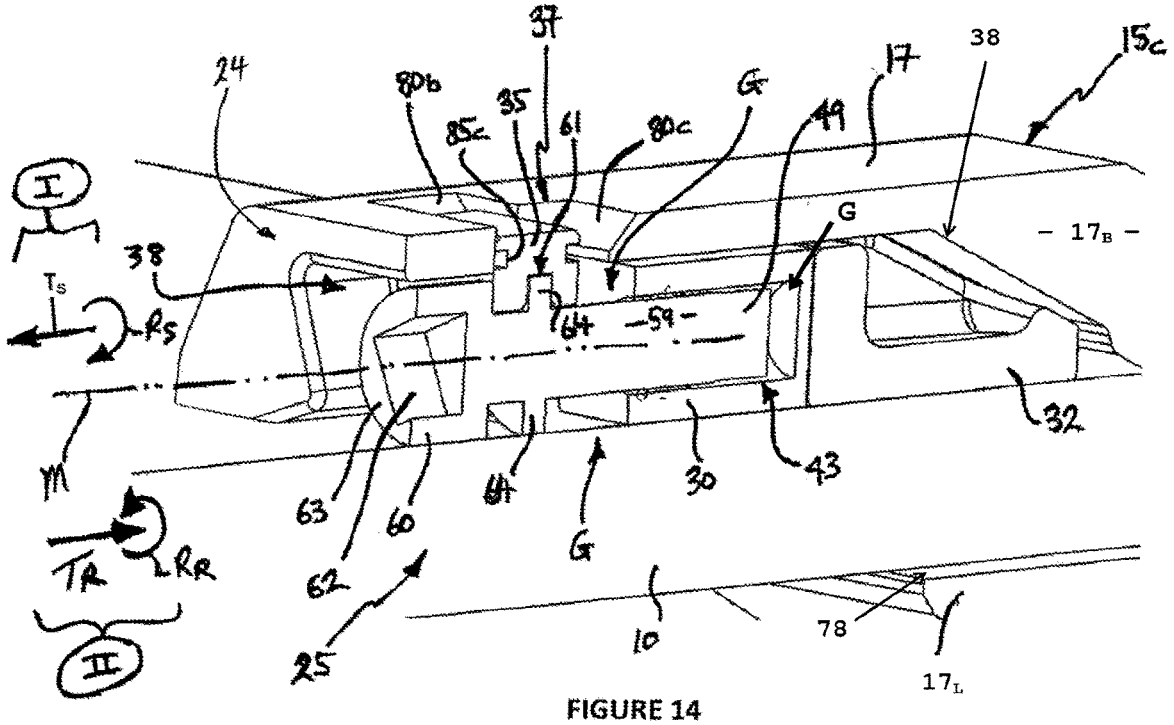
FIG. 14 shows a cross-section view showing an advancement of that shown in FIG. 13 in the process of securing the GET with the bucket of the earth moving equipment/vehicle, indicating the operation of the attachment assembly in securing the moving equipment/vehicle in position.

As shown in FIG. 6, the moveable jaw 35 comprises an opening 50 (reminiscent of an arch like form) which extends between first 52 and second 54 opposite sides of the moveable jaw for defining leg portions 56, 58. The moveable jaw 35 further comprises a slot 61 formed between the first 52, second 54 sides (as shown in FIGS. 6 and 14). The slot 61 formed in the moveable jaw 35 is configured so as to receive or accommodate (the path of such receiving is indicated by reference T, shown in FIG. 6) so as to operably capture the annular flange 64 (when assembled therewith in the manner shown in FIG. 8) of the operable element 40, while allowing it to rotate about the axis M. Rotation of the operable element 40 about the axis M causes translational movement (via the threaded engagement between the operable element 40 and the blind hole 43 of the fixed jaw 30) of the annular flange 64 along the axis M which, with the annular flange 64 being caught within the slot 61, drives movement of the moveable jaw 35 (away from the landing face 11 in the increasing direction of axis L) due to the annular flange 64 pushing against the moveable jaw 35.

The annular flange 64 is formed of circular form to allow it to rotate with the slot 61 between leg portions 56, 58, and its flange portions are provided with structurally sufficient 'shoulders' so as to bear against the interior walls of the slot 61 with sufficient force for driving the moveable jaw 35.

The operable element 40 is arranged so as to operably associate the fixed 30 and moveable 35 jaws so that the attachment assembly 25 is responsive to operation of the operable element 40 in a first mode, in which the moveable jaw 35 is caused to be moved (or separated) away from the fixed jaw 30 subjecting the shroud 17 to a force for retaining the GET $\mathbf{15}_C$ with the edge portion 10, and, a second mode of operation, in which the moveable jaw 35 is caused to be moved toward the fixed jaw 30 thereby reducing or releasing the shroud 17 from the applied force for facilitating removal of the GET $\mathbf{15}_C$ from the earthmoving equipment/vehicle.

The operable element 40 further comprises annular seal elements 70, 72 (such as for example, rod wipers/scrapers, o-rings, and the like) (see FIGS. 6 and 7) provided about the shaft portion 59 between the distal end of the shaft portion and the annular flange 64. The seal elements 70, 72 serve to protect (to the extent possible) operable regions of the operable element 40 (eg. the threaded regions which engage) from ingress of 'fines' during operation of the earthmoving machine. The seal elements 70, 72 are applied to the operable element 40 during manufacturing assembly of the attachment assembly 25. In an alternate arrangement, each of the seal elements 70, 72 could be provided with the blind hole of the fixed jaw 30.

Figure 7B:
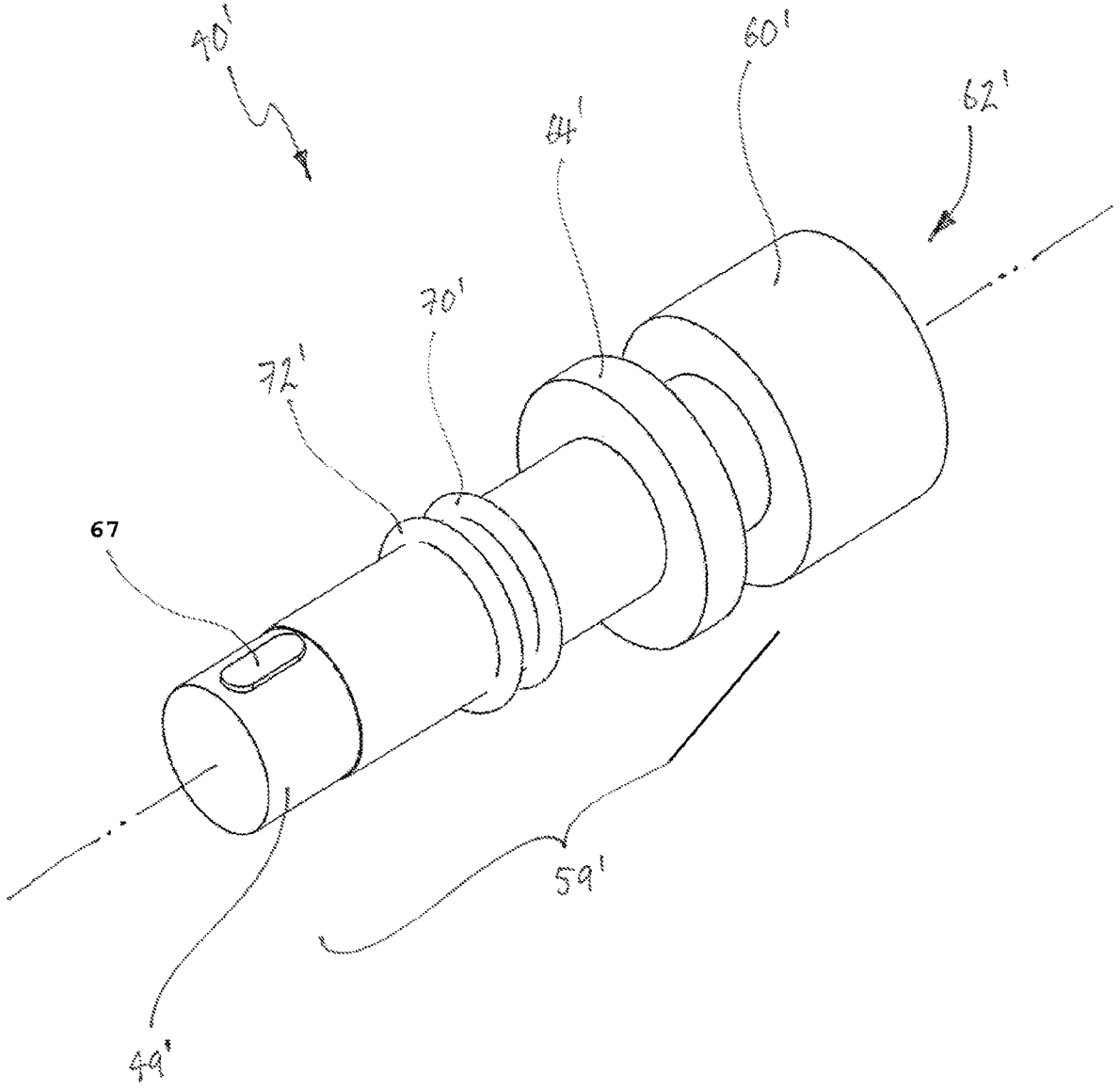
FIG. 7B shows a perspective view of another embodiment of the operable element shown in FIG. 7A.
Figure 9:
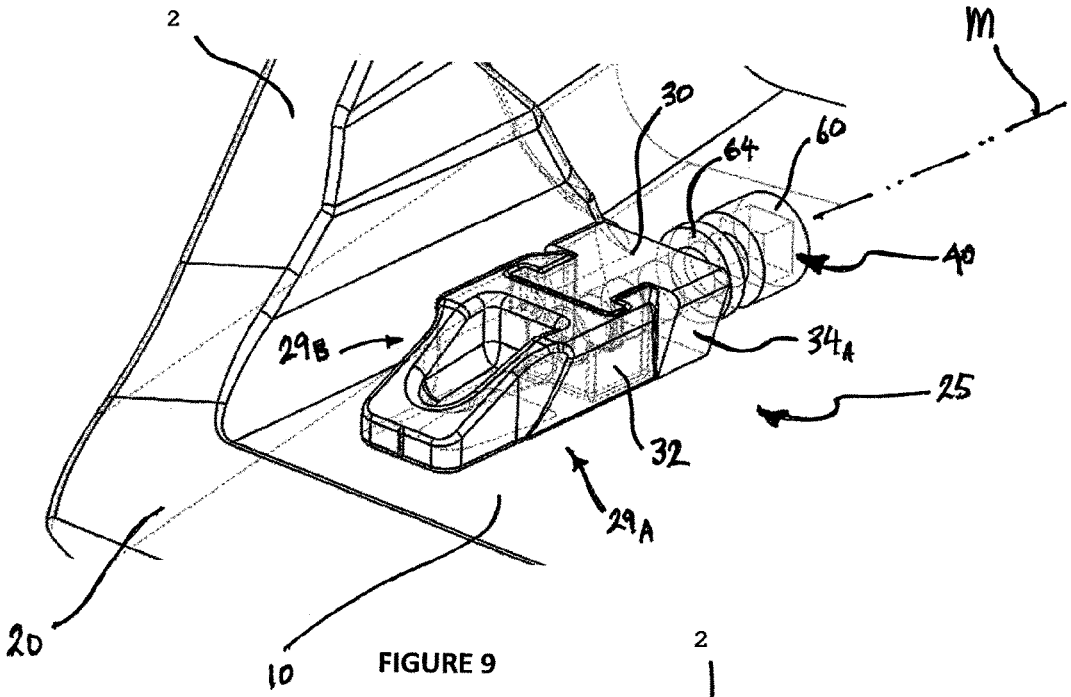
FIG. 9 shows a perspective view of the assembled components shown in FIG. 8, in-situ with the bucket of the relevant earth moving equipment/vehicle (with the GET omitted)

FIG. 7B shows an embodiment 40' of the operable element in which a nylon block 67 is provided in a recess formed in the threaded portion 49' of the shaft portion 59'. As shown in FIG. 7B, the nylon block 67 is of elongate form (oriented axially so as to align with the axis of the shaft portion 59') and positioned so as to sit proud of the exterior surface of the shaft. The placement of the nylon block 67 is configured so as to cooperate with the (male) thread of the threaded portion 49' so as to seek to reduce, to the extent possible, any "play" that might develop between the operable element 40' when operable in the blind hole 43. In this regard, the nylon block 67 serves to operate as a means of conferring/facilitating additional friction for keeping the operable element 40' in its intended position and limit its tendency to work itself free (due to any "backlash" that might be experienced) during on-going loading cycles during ground engaging operations.

Briefly, and as will be described in further detail below, in operation, and with the landing face 11 of the lip portion 2 received within the opening 78 of the shroud 17 (which snugly receives the edge portion 10), in the first mode of operation (mode I, indicated in FIG. 14), driving of the moveable jaw 35 in a first direction $T_S$ (which is substantially aligned with the axis M) on rotation of the operable element 40 about the axis of rotation M in the direction of rotation $R_S$ (rotation-securement) operates to subject the GET $\mathbf{15}_C$ to a force for hold/securing the shroud 17 against the landing face 11 and edge portion 10. Thus, holding of the GET $\mathbf{15}_C$ against the landing face 11/edge portion 10 in the first mode I of operation involves subjecting the shroud 17 to a force, by way of the separation of the fixed 30 and moveable 35 jaws via operation of the operable element 40, holding the shroud 17 firmly against the landing face 11/edge portion 10.

Furthermore, in the second mode of operation (mode ii, indicated in FIG. 14), driving of the shroud 17 by the moveable jaw 35 in a second direction $T_R$ (which is substantially aligned with the axis M) on rotation of the operable element 40 about the axis of rotation M in the direction of rotation $R_R$ (rotation-release—which is substantially opposite to the direction of rotation $R_S$) operates to release a force causing the shroud 17 to remain in its 'held' position against the edge portion 10. The removal of the shroud 17 in the second mode II therefore involves reducing a force, by way of reducing the separation of the fixed 30 and moveable 35 jaws via operation of the operable element 40, to which the shroud 17 is subject to in holding it against the edge portion 10.

It will be appreciated that the directions of rotation $R_S$, $R_R$ of the operable element 40 that correspond with respective modes of operation I, II can be changed (for example, reversed) as might be desired for reasons of convenience (eg. for operators in the field) or application. The skilled reader would readily appreciate that such a change can be made by changing the configuration of the engaging (male/female) threads applied to the shaft portion 59 of the operable element 40 and to the blind hole 43.

The channel 38 is configured for receiving the boss 32 when the shroud 17 is being positioned relative to the edge portion 10 for securement thereto. In one form of assembly, the fixed jaw 30 is first interconnected with the boss 32, and the shroud 17 fitted in position relative to the landing face 11 and the edge portion 10 for securement. Thus, in at least one embodiment, the channel 38 is configured so as to be substantially parallel to a longitudinal extent of the shroud 17 and operable for receiving both the boss 32 and the fixed jaw 30 when the shroud 17 is being positioned relative to the edge portion 10. The channel 38 may be configured so as to be complementary in shape to the effective shaping/profile of the boss 32 and the fixed jaw 30 when in their affirmative/interconnected engagement such that both can be snugly received and retained in the channel 38 when the shroud 17 is in position such that the shroud is restricted to move relative to the boss 32 and the fixed jaw 30 along a length of the channel 38. As shown, the boss 32 and the fixed jaw 30 are configured having tapering/dove-tail sidewalls so that as the channel 38 slides over the boss 32 and the fixed jaw 30 the shroud 17 self centres and self-aligns with respect to the boss 32 (and the interconnected fixed jaw 30). Such interaction, advantageously, enhances the fit of the shroud 17 with respect to the edge portion 10.

Of course, embodiments can be realised where the operability described above may only be required in respect of the boss 32 itself, for example, where the fixed jaw 30, while interconnected with the boss 32, has a smaller profile not warranting shaping for interacting with the channel 38.

When fitting the shroud 17 to the landing face 11 and edge portion 10, the channel 38 is positioned relative to the boss 32 and the fixed jaw 30 so that the shroud 17 can be slidingly received there over, and the edge portion 10 is received in the first opening 78. The channel 38 may commence a distance from an end of the shroud 17 distal of the ground engaging region $\mathbf{17}_{G\text{-}E}$ of the shroud, and extend towards the ground engaging region $\mathbf{17}_{G\text{-}E}$ and terminating a distance therefrom.

One embodiment for installing the GET $\mathbf{15}_C$ using the attachment assembly 25 will now be described.

Broadly, during installment of the GET $\mathbf{15}_C$ with the edge portion 10 of the lip portion 2, the shaft portion 59 of the operable element 40 is inserted into and threadedly engaged with the blind hole 43 of the fixed jaw 30. Once the fixed jaw 30 and the operable element 40 are engaged with one another, the fixed jaw is placed into its interconnecting relationship with the end 33 of the boss 32.

Figure 11:
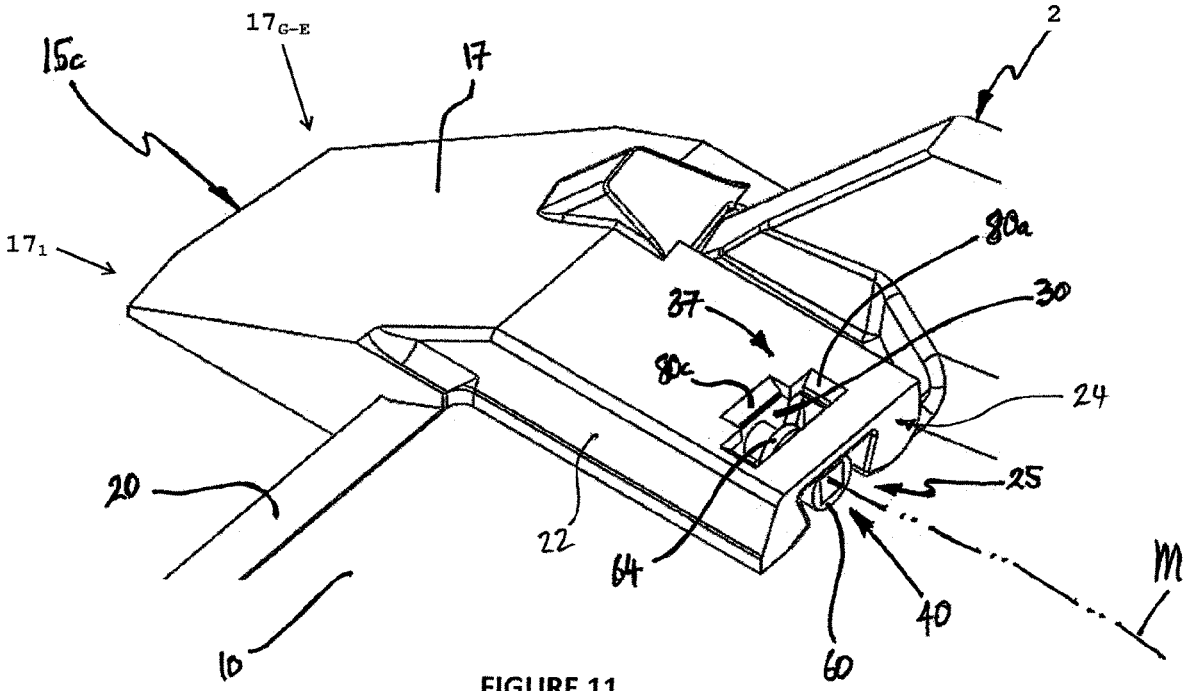
FIG. 11 shows an advancement of that shown in FIG. 10 in the process of securing the GET with the bucket of the earth moving equipment/vehicle.

With reference to FIG. 10, with the fixed jaw 30 interconnected with the boss 32, the shroud 17 is manoeuvred (for example, in direction Y which is generally aligned substantially parallel with the axis L) so that its opening 78 (snugly) receives the landing face 11 and the edge portion 10 with the channel 38 passing over the boss 32 and the interconnected fixed jaw 30, thereby achieving the configuration shown in FIG. 11. In this manner, the GET $\mathbf{15}_C$ is positioned in respect of the landing face 11/edge portion 10 and ready to be constrained in position as the fixed 30 and moveable 35 jaws are caused to separate during operation of the attachment assembly 25 in the first mode.

With reference to now to FIG. 12, once the shroud 17 is in position relative to the boss 32 and the interconnected fixed jaw 30, the moveable jaw 35 is then manoeuvred (for example, in direction S (which is generally aligned parallel with axis H), as indicated in FIG. 12) so as to be inserted into the channel 38 via the upper opening 37 such that the annular flange 64 of the operable element 40 is received (and captured) within the slot 61 of the moveable jaw 35, thereby achieving that shown in FIG. 13.

Of course, the skilled reader will appreciate other orders of operation that resolve in the assembly of the attachment assembly 25 with the shroud 17 required, depending on the circumstances to hand.

With reference now to FIG. 14, operation of the attachment assembly 25 in securing the GET $\mathbf{15}_C$ in position with the bucket 5 will be described.

Following from that shown in FIG. 13, an operator then attends to manual operation of the operable element 40 by way of engaging an appropriate drive tool with the drive cavity 62 of the head portion 60.

For securing the GET $\mathbf{15}_C$ with the landing face 11/edge portion 10 (ie. the first mode of operation; denoted as I in FIG. 14), the operator rotates the operable element 40 in the first direction $R_S$ of rotation (rotation-securement, eg. clockwise) about the axis M thereby causing the annular flange 64 to translate axially along the axis M toward the left of page in direction $T_S$ (translate-securement). In this manner, axial movement of the annular flange 64 (ie. increasing movement away from the landing face 11 along axis L) pushes against the moveable jaw 35 axially causing it to be moved/driven away from the fixed jaw 30—this is due to the affirmative/positive engagement between the annular flange 64 and the moveable jaw 35 via the slot 61. In turn, the moveable jaw 35 pushes against portion(s) of the shroud 17 adjacent the upper opening 37. In effect, the fixed jaw 30 and the moveable jaw 35 are caused to increasingly space apart from one another on rotation of the operable element 40. With the fixed jaw 30 interconnected with the boss 32, and bearing/reacting thereagainst during the rotation of the operable element 40 in the first direction, the shroud 17 is caused to increasingly (with each rotational movement about the axis M) bear against the edge portion 10.

Thus, the cooperability of the threads applied to the interior facing surface of the blind hole 43 and the exterior surface of the shaft portion 59 of the operable element 40 is such that rotation $R_S$ of the operable element 40 about the axis M results in axial translation $T_S$ of the operable element 40 (to left of the page in FIG. 14) in the securing of the shroud 17 with the edge portion 10 via the first mode of operation. For the present embodiment, the corresponding direction of rotation of the operable element 40 in achieving securement between the shroud 17 and the edge portion 10 is clockwise (or the reverse direction of rotation as would normally be expected when seeking to affect a tightening of two components threadedly engaged with one another).

During the securement process, the shroud 17 is pulled up so as to bear snugly against the edge portion 10, during which gaps G (see FIG. 14) are created following tightening, thus expanding the overall length of the attachment assembly 25. FIG. 14 shows the (male) threaded portion 49 of the shaft portion 59 following clockwise ($R_S$) rotation (using a drive tool inserted into the drive cavity 62) having established increased separation of the moveable jaw 35 from the fixed jaw 30 and pulling the shroud 17 up to/against the edge portion 10.

As the securement process progresses, the tapered/dovetail shaped sides/shoulders $\mathbf{29}_A$, $\mathbf{29}_B$ of the boss 32 interact with corresponding portions of the interior surface(s) of the channel 38 of the shroud 17. As the shroud 17 is increasingly pulled up toward the edge portion 10, the interaction of the tapered/dovetail shaped sides/shoulders $\mathbf{29}_A$, $\mathbf{29}_B$ with the corresponding portions of interior surface of the channel 38 serves to help locate/converge the shroud 17 toward a desired (aligned/centered) position where it is held tightly against the edge portion 10. As shown in FIG. 4, the shape of the sides $\mathbf{29}_A$, $\mathbf{29}_B$ is such that they taper from the base of the boss 32, where it meets with the surface of the edge portion 10, outward as the boss extends away from the surface of the edge portion. Interaction between the tapered/dovetail shaped sides/shoulders $\mathbf{29}_A$, $\mathbf{29}_B$ of the boss 32 and corresponding portions of the interior surface(s) of the channel 38 of the shroud 17 assist in limiting or reducing the stresses that can become induced on the components of the attachment assembly 25.

Furthermore, the fixed jaw 30 comprises opposite sides $\mathbf{34}_A$, $\mathbf{34}_B$ which are shaped or configured so as to substantially continue the tapered/dovetail shaping of the sides $\mathbf{29}_A$, $\mathbf{29}_B$ of the boss 32, as shown in FIG. 5. In this regard, the shape of the sides $\mathbf{34}_A$, $\mathbf{34}_B$ of the fixed jaw 30 is therefore configured so as to be substantially consistent with respective adjacent sides $\mathbf{29}_A$, $\mathbf{29}_B$ of the boss 32 such that sides $\mathbf{34}_A$, $\mathbf{34}_B$ taper from the base of the fixed jaw 30, where it meets with the surface of the edge portion 10, outward as the fixed jaw extends away from the surface of the edge portion. In this configuration the sides $\mathbf{34}_A$, $\mathbf{34}_B$ of the fixed jaw 30 are substantially flush with their respective adjacent side $\mathbf{29}_A$, $\mathbf{29}_B$ of the boss 32.

The continuance of the tapering/dovetail shaping across the sides $\mathbf{29}_A$, $\mathbf{29}_B$ of the boss 32 and the sides $\mathbf{34}_A$, $\mathbf{34}_B$ of the fixed jaw 30 assists in the interaction with the channel 78 of the shroud 17 as the shroud 17 is pulled up toward/against the edge portion 10 ensuring that the movement is as fluid as possible with minimal disruption, if any.

As will be seen from the Figures, both the fixed jaw 30 and the moveable jaw 35 are configured so as to be substantially symmetrical about a vertical plane passing through the axis M.

During operation of the earthmoving equipment/vehicle, it is often the case that the GETs 15 develop a degree of 'play', which can reduce their efficiency during use. The attachment assembly 25 is advantageous in that such 'play', when identified, can be readily reduced by way of an operator simply attending to the operable element 40 and rotating same in the first direction of rotation as would be done during installation. Thus, the configuration of the attachment assembly 25 allows for ready installation of the GET $\mathbf{15}_C$ as well as for subsequent 'retightening' or positive adjustment during use of the GET $\mathbf{15}_C$. For the present embodiment, around twice the length of the male thread applied to the threaded portion 49 of the shaft portion 59 of the operable element 40 is provided on the interior surface portion of the blind hole 43 to allow for tightening/retightening purposes. The skilled reader will understand that this could be configured as might be required for specific application/use.

Removal of the GET $\mathbf{15}_C$ from the landing face 11/edge portion 10 initially requires, if necessary, removal of any fines that have accumulated in any exposed crevices about the shroud 17. Thus, an initial stage of the removal operation may involve removing fines from back of the shroud 17 and from inside the attachment assembly 25, especially the drive cavity 62 of the operable element 40. The objective of this stage is to remove any fines that may impede access to, and operation of, the operable element 40.

With respect to FIG. 14, once any accumulated fines are removed, removal of the GET $\mathbf{15}_C$ using the attachment assembly 25 is achieved by way of the operator rotating (using a drive tool) the operable element 40 in the second direction $R_R$ of rotation (rotation-release, eg. counterclockwise) about the axis M in a manner causing the operable element 40 to translate axially along the axis M toward the right of page in direction $T_R$ (translate-release) (ie. the second mode of operation, denoted as II in FIG. 14) thereby causing the annular flange 64 to push against the moveable jaw 35. In this manner, movement of the moveable jaw 35 pushes against the shroud 17 so as to move the shroud toward the front landing face 11 of the edge portion 10 sufficiently to remove the securing force. This process helps to free the shroud 17 from the edge portion 10 and/or the 'dovetail' shaped sides/shoulders $\mathbf{29}_A$, $\mathbf{29}_B$ of the boss 32.

As foreshadowed above, the direction of the second direction of rotation $R_R$ about the axis M is counterclockwise, or the reverse of that for the securement process (first mode of operation I).

As noted, it is often the case that removal of a GET $\mathbf{15}_C$ is difficult due to fines incurred from ground engagement events accumulating in exposed crevices (which can become significantly compacted) of the shroud 17 and/or the attachment assembly used to fasten/secure the GET $\mathbf{15}_C$ with the edge portion 10. To assist in the removal of the GET $\mathbf{15}_C$ when used on the connection with the attachment assembly 25 described herein, one or more portions of the shroud 17 that are adjacent to edges of the upper opening 37 of the shroud 17 is/are formed having angled or inclined faces $\mathbf{80}_A$, $\mathbf{80}_B$, $\mathbf{80}_C$ that are shaped/configured so as to be of use in the extraction of the moveable jaw 35 from the upper opening 37. The angled or inclined faces $\mathbf{80}_A$, $\mathbf{80}_B$, $\mathbf{80}_C$ are configured so as to slope downward so as to expose side portions of the moveable jaw 35 that are configured so as to provide respective slots (collectively, 85) formed therein which slots can be used for prising/leveraging of the moveable jaw 35 from the upper opening 37 if needed.

Figure 8:
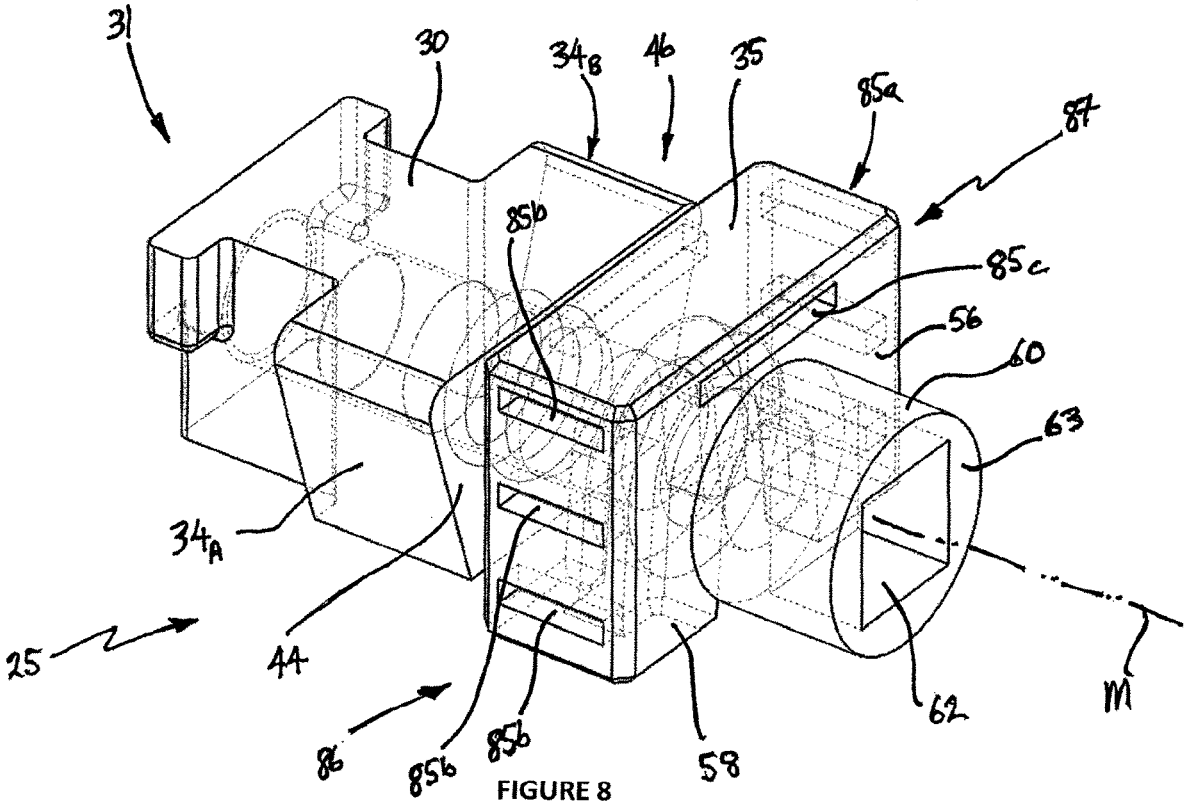
FIG. 8 shows a perspective view of the parts shown in FIGS. 5 to 7A in an assembled condition.

As shown in FIGS. 7A, 8, and 14, angled/inclined face $\mathbf{80}_A$ slopes downward to expose and facilitate access to the opening of slot $\mathbf{85}_A$, angled/inclined face $\mathbf{80}_B$ slopes downward to expose and facilitate access to the opening of slot $\mathbf{85}_B$, and angled/inclined face $\mathbf{80}_C$ slopes downward to expose and facilitate access to the opening of slot $\mathbf{85}_C$. Each of the slots 85, once exposed (ie. any relevant fines removed so as to enable access thereto) can be used as points of leverage for extracting the moveable jaw 35 from the upper opening 37 (for example, by inserting an end of a crowbar or equivalent into the relevant slot 85 and working the moveable jaw 35 upwards). As seen in FIGS. 7 and 8, the sides 86, 87 of the moveable jaw 35 comprise respective sets of three slots $\mathbf{85}_B$, $\mathbf{85}_A$ each of which can be used as required in the prising/leveraging of the moveable jaw 35 from the opening 37.

Accordingly, with any accumulated fines removed, once the shroud 17 is pushed forward to the desired position, a crowbar or equivalent can be inserted into any of the slots 85 (ie. upper slot $\mathbf{85}_C$ or side slots $\mathbf{85}_A$, $\mathbf{85}_B$) of the moveable jaw 35 to prise/leverage the configuration out through the upper opening 37 in the top of the shroud 17. The tapered form of the angled/inclined faces $\mathbf{80}_A$, $\mathbf{80}_B$, $\mathbf{80}_C$ serves to facilitate this process. In some instances, the operable element 40 may need to be manipulated as appropriate so that the shaft portion 59 is turned slightly back clockwise prior, to remove the portions of the annular flange 64 that make contact with the moveable jaw 35 to allow easier extraction (ie. to reduce or eliminate any relevant bearing forces that may still exist). Movement of the operable element 40 in either directions $T_S$, $T_R$ may be needed as appropriate in order to cause sufficient release of the moveable jaw 35 form the upper opening 37.

While the attachment assembly 25 described herein is in the context of a GET $\mathbf{15}_C$ configured for attachment with a respective corner of the edge portion 10 of the bucket 5, it will be appreciated that embodiments of the attachment assembly 25 could be readily applied for use in securing the alternate version of the GET 15 (ie. those disposed between the corners of the bucket 5) without departing from the principles described herein. As the skilled reader would appreciate, it can be the case that more adversity is encountered when seeking to remove the corner GETs $\mathbf{15}_C$, for at least the reason that it is these GETs that are more exposed (ie. being exposed both to the side and front aspects of the bucket) during operation than those GETs residing between the corner regions.

As the skilled reader would be well aware, the shrouds 17 of the GETs 15 are made from ground engaging grade steel. Other metallic components used on the attachment assembly 25 are formed from other steel compositions (as appropriate for their operation), and some of the componentry, such as for example 'o'-rings and rod wipers/scrapers are formed from rubber, plastic, or steel/rubber/plastic laminates. The skilled reader would be well aware of the materials from which various of the componentry described herein is appropriately formed.

Additional features may comprise plugs for use in filling/plugging any gaps or cavities which form on the top (upper facing side of the shroud 17; for example, around the upper opening 37), and/or the rear side 24 as the attachment assembly 25 is operated in the first mode for fastening the GETs $\mathbf{15}_C$ in position against the edge portion 10, as such gaps/cavities can readily allow for the build-up of fines during operation of the earthmoving machine. The geometry of appropriate parts may be configured as required so as to facilitate extraction of the moveable jaw 35. Furthermore, other means may be configured so as to operate to restrict or limit the build-up of fines, such as for example, plugs, sprays, liquids, etc.

The attachment assembly 25 may further comprise, or be arranged operable with, a retention means, device, or system operable between a portion of the moveable jaw 35 and a portion of the shroud 17 or the operable element 40 for establishing a mutual engagement or interaction (preferably in a substantially quick or snap fit manner) that is operable for retaining or preserving the position of the moveable jaw 35 relative to the shroud 17 following insertion/placement of the moveable jaw 35 through or into the upper opening 37 (ie. the retention means/device operable so as to impede the moveable jaw 35 from lifting upwards through the upper opening 37).

Figure 24:
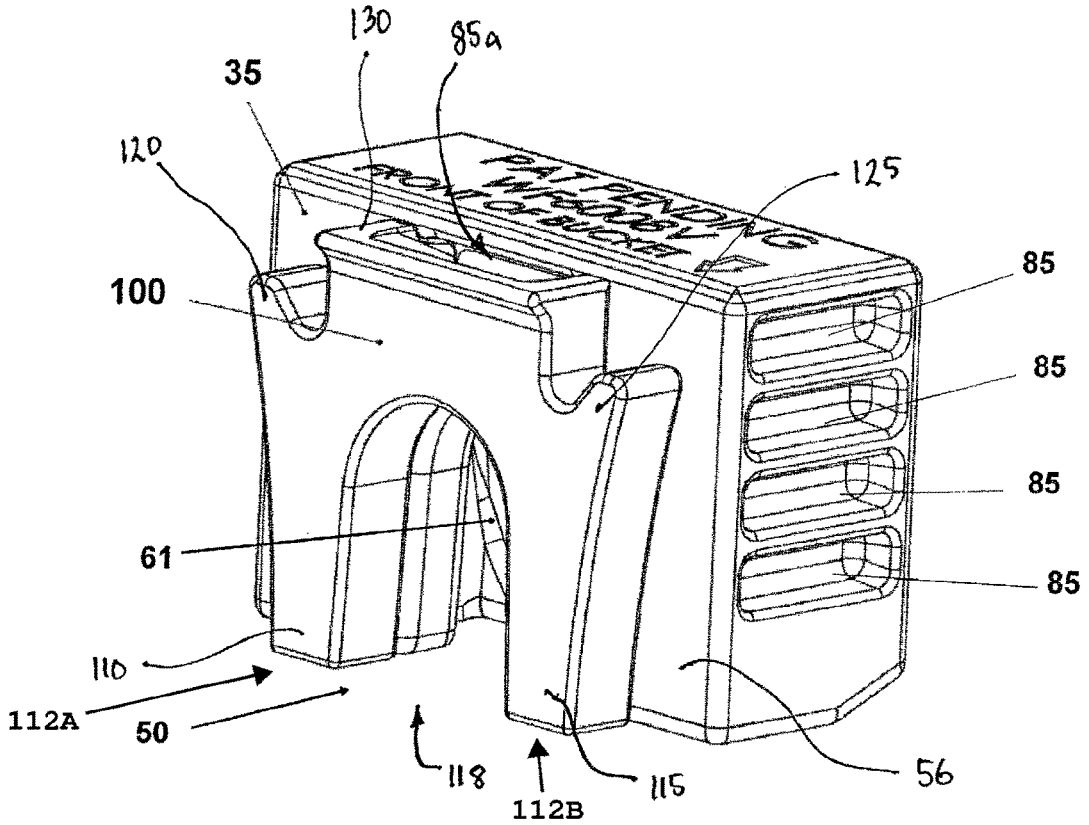
FIG. 24 shows a perspective view of one embodiment of the moveable jaw, formed in accordance with the principles described herein, in which the moveable jaw is provided with a retainer element.
Figure 25:
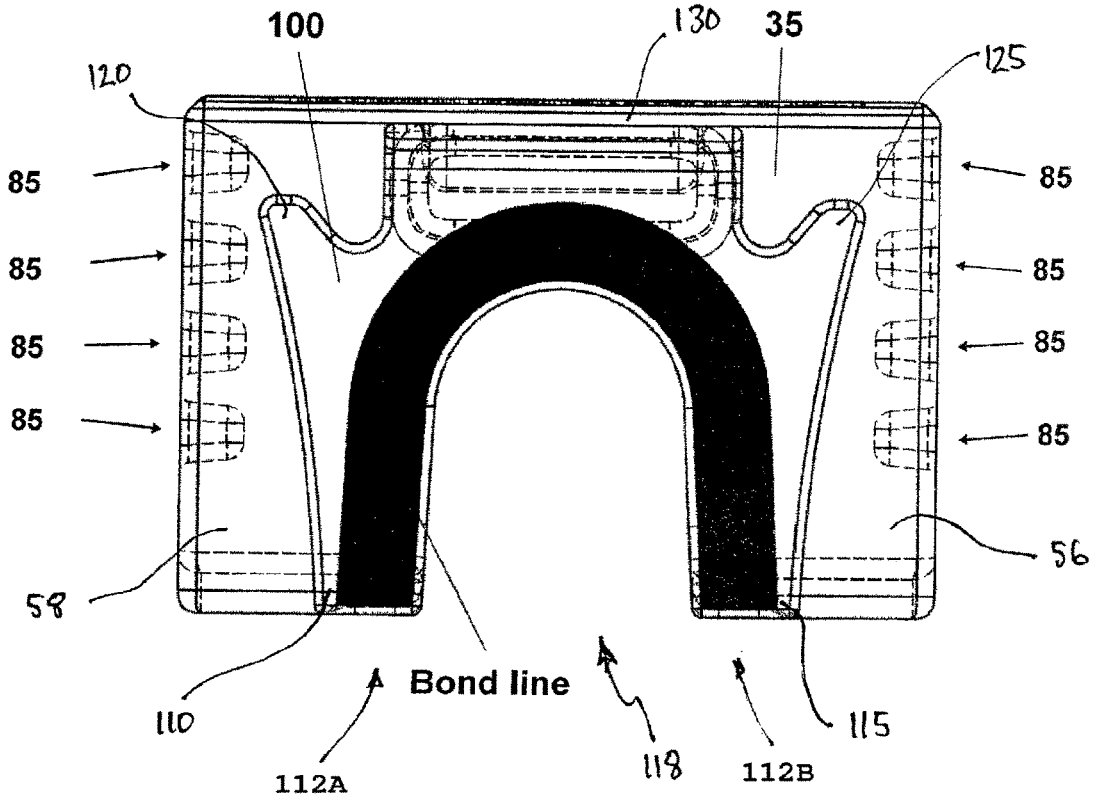
FIG. 25 shows a side view of the embodiment of the moveable jaw and retainer element shown in FIG. 24.
Figure 26:
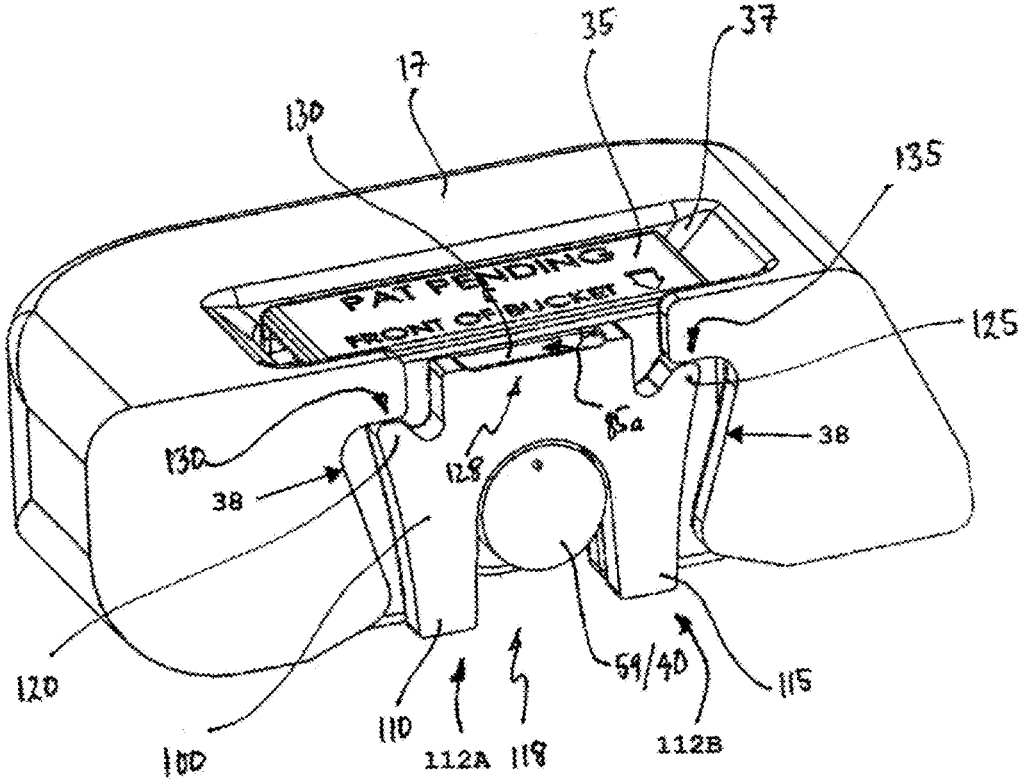
FIG. 26 shows one embodiment of a retention means or device operable with a form of the attachment assembly described and shown herein, showing a cut-away cross-section perspective view of the embodiment of the moveable jaw (35) and a retainer element (100) shown in FIGS. 24 and 25, with the moveable jaw having been inserted through the opening (37) of the shroud (17) and the retainer element engaged with portions of the shroud so as to mitigate against a risk of the moveable jaw becoming dislodged.

For example, in one embodiment shown in FIGS. 24 to 26, the moveable jaw 35 is configured so as to carry a retainer element 100 configured operable for engaging with the shroud 17 for preventing/impeding the moveable jaw 35 from working its way upwards and out of the upper opening 37; for example, in cases when, if, prior to the need for retightening of the attachment assembly 25 is identified, the attachment assembly develops sufficient play that increases a risk that the moveable jaw 35 could work free (eg. if the operable element 40 is not sufficiently tight up against the moveable jaw 35). With specific reference to FIGS. 24 and 25, the retainer element 100 is shown bonded with aside of the moveable jaw 35 by way of a vulcanisation process. The bonding region between the retainer element 100 and the moveable jaw 35 is identified by the black solid region marked "Bond line". While a vulcanisation bonding process has been used for the embodiment shown, the skilled reader will appreciate that other bonding/adhesive processes/technologies could be used as appropriate.

With specific reference to FIGS. 24 to 26, for the most part, the retainer element 100 is of finite thickness and generally of uniform cross section. The general form of the retainer element 100 echoes the general form of the opening 50 of the moveable jaw 35. In this regard, the retainer element 100 comprises a similar arch like form (similar to the arch like form of the moveable jaw 35 seen clearly in FIG. 6) dimensioned so as to receive the shaft 59 of the operable element 40 when the slot 61 of the moveable jaw 35 receives the annular flange 64 during assembly/insertion through the upper opening 37 in the shroud 17. With reference to FIG. 24, the retainer element 100 comprises spaced apart leg portions 110, 115 extending respectively from respective base portions 112A, 112B (adjacent the open region of the arch like form) upwards to spaced apart shoulder portions 120, 125. The distal extents of each of the shoulder portions 120, 125 function to engage with respective corresponding portions 130, 135 provided on an interior surface of the channel 38 (see FIG. 14) of the shroud 17, as clearly shown in the cut-away cross section drawing shown in FIG. 26—in which the retainer element 100 is shown in its operable state preventing or preserving the position of the moveable jaw 35 relative to the shroud 17, ie. impeding the moveable jaw 35 from working its way upwards and out of the upper opening 37. An end 128 distal of the base portions 112A, 112B provides a recessed area 130 which opens to the slot 85*a* (seen in FIG. 5) of the moveable jaw 35, which slot provides a means for a tool to be insertable therein and used for affirmatively leveraging the moveable jaw 35 out of the upper opening 37 for replacement/maintenance purposes.

The retainer element 100 shown is formed of an elastomeric material, such as for example a vulcanized rubber material (eg. having a Shore A 60 hardness), so as to comprise a degree of resilience (ie. a resilient characteristic) allowing the retainer element 100 capacity to exhibit a degree of deformation when subject to a handling operation involving a compressive action causing the shoulders 120, 125 to be brought or squeezed toward each other (by manual manipulation as a quick fit operation or by way of being forced or pushed/hammered through the small size space 37B of the upper opening 37) so as to reduce the profile of the retainer element 100 sufficient for insertion into/through the small size space 37B of the upper opening 37, and being capable of returning to its normal form on cessation of the handling operation (ie. release of the compressive action once through the small size space 37B). Accordingly, the term 'resilience' or 'resilient' is used in the context whereby the retainer element 100 is able to return to its normal shape or form (once through or clear of the periphery defining the small size space 37B of the upper opening 37) following completion of the insertion of the moveable jaw 35 and the retainer element 100 through the upper opening 37 so that the shoulder portions 120, 125 (shown in FIG. 26) are engageable with the respective corresponding portions 130, 135 provided on the interior surface of the channel 38 (as shown in FIG. 26) of the shroud 17 in order to provide the retaining/retention functionality to ensure that the position of the moveable jaw 35 relative to the shroud 17 is maintained/preserved (ie. the moveable jaw 35 is sufficiently impeded from lifting upwards out of such position relative to the shroud 17). The resilient characteristic or property of the material from which the retainer element 100 is formed from is selected so as to ensure that the engagement between the retainer element 100 and the shroud 17 is of sufficient structural integrity or capacity to function accordingly.

Installation of the moveable jaw 35 when carrying the retainer element 100 involves compressing or forcing, or causing/facilitating same, both its shoulders 120, 125 toward each other sufficiently (by manual or forced action) so that both components are insertable through respective regions of the upper opening 37 into the desired position. Once in position, the resilience of the retainer element 100 enables the shoulders 120, 125 to expand or return to their normal shape/form so as to be engageable with respective corresponding portions 130, 135. In the removal of the moveable jaw 35 where the retention element 100 is used, an initial step will require the retainer element 100 (or any portion(s)/projection(s) thereof) to be disengaged from the moveable jaw 17 regardless of whether the retainer element 100 is carried by the moveable jaw 35 or the shroud 17.

While the retention element 100 is formed from rubber, the skilled reader would be aware of other types of materials and/or constructions that could be used. In this regard, any portion or component of the retention means/device may comprise (i) a metallic material (eg. a suitable spring steel), or (ii) an elastomeric material (eg. vulcanised rubber or otherwise), or (iii) a combination of both a metallic and an elastomeric material (such as retainer elements 102A, 102B shown in FIGS. 27 and 28, and described below). The skilled reader will appreciate that any suitable hard wearing metallic (eg. spring steels or similar) or elastomer/elastomeric type material could be used that the skilled person would consider appropriate for the function and intended operating environment.

Arrangements of the retention means/device may be configured so as to be attached or carried by either the moveable jaw 35 or the shroud 17. In the embodiment shown in FIGS. 24 to 26), the retainer element 100 is attached (bonded) with the moveable jaw 35 whereby the shoulder portions 120, 125 are engageable with respective corresponding portions 130, 135 of the channel 38 of the shroud 17 by way of, at least in part, the resilient characteristic of the retainer element 100 allowing the engagement to occur by virtue of the form of the retainer element 100 returning to its normal shape/form following insertion with the moveable jaw 35 and the retainer element 100 into/through the upper opening 37.

Alternatively, a form of a retention means/device can be attached with the shroud 17 whereby, in at least one arrangement, such retention means/device may comprise one or more projections that are bonded to one or more interior surfaces of the shroud 17 and that are configured to be engageable with one or more respective corresponding recesses formed in the moveable jaw 35 by way of, at least in part, a resilient characteristic (retention means/device) enabling the projection(s) to enter the respective recess(es) once the moveable jaw 35 is inserted through/into the upper opening 37 into its desired relative position with the shroud 17. During installation the relevant projection(s) may need to be manipulated so as to allow the moveable jaw 35 to be inserted through the upper opening 37 and positioned appropriately, following which the projection(s) can be allowed to expand into the respective corresponding recesses. Removal will require the moveable jaw 17 to be disengaged from the retention means/device.

In another arrangement, a form of a retention means/device may be configured so as to be carried by or attached with the moveable jaw 35 and configured so as to engage or interact with the operable element 40 (for example, via an engagement or interaction with a portion or section of the shaft 59) in operating to prevent or impede the moveable jaw 35 from lifting upwards through the upper opening 37.

Figure 27:
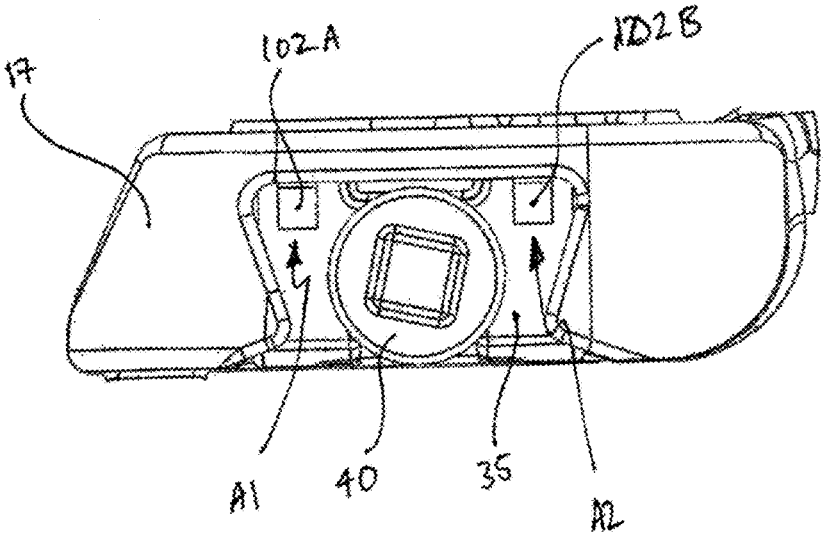
FIG. 27 shows an aspect (in direction $V_R$ identified in FIGS. 28 and 29) of the shroud (17) when viewed from behind (or toward the front of the bucket) the shroud with other potential locations for engagement between the retainer element (100) and internal regions of the shroud being identified.

The skilled reader will appreciate that many different configurations are possible in which the retention means/device could be carried by the moveable jaw 35 (and, indeed, by the shroud 17). For example, FIGS. 27 and 28 both show an arrangement of a retention means/device that is different to that shown in FIGS. 24 to 26. FIG. 27 shows a view looking from the rear of the excavator bucket toward the front lip of the bucket (in the direction of VR identified in FIGS. 28 and 29) indicating areas A1 and A2 where metallic retainer element(s) or clips 102A, 102B are operably attached/associated with the moveable jaw 35 for operable engagement with respective corresponding portions 104A, 104B (not shown but inferred) of the interior of the channel 38 of the shroud 17. FIG. 28 shows a cut-away section of the retainer element 102A (area A1 identified in FIG. 27) projecting outward from a side of the moveable jaw 35 so as to engage with portion 104A of the shroud 17. Retainer element 102A is of wedge like form and operably associated (using any suitable form of attachment means) with an elastomeric body 103A which is positioned within a recess 106A formed within the shown side of the moveable jaw 35. A portion of the retainer element 102A is shown to also sit partially within the recess 105A so as to, in effect, key the moveable jaw 35 with the shroud 17 for impeding upward movement of the moveable jaw 35 back through the upper opening 37. Consistent with the description above, as the moveable jaw 35 is inserted through the upper opening 37, the resilient nature of the elastomeric body 103A allows the retainer element 102A to move inwards of the recess 106A (in a different direction of motion as was seen with the shoulder portions 120, 125 of the retainer element 100) due to pressure applied by the sliding engagement between a ramped face 107A of the retainer element 102A and the periphery of the upper opening 37. Once the insertion is completed, and the retainer element 102A clear of the shroud 17, the resilient nature of the elastomeric body 103A pushes the retainer element 102A outward of the moveable jaw 35 so that a portion of a face 108A of the retainer element 102A engages, or is engageable with, its corresponding portion 104A.

Figure 29:
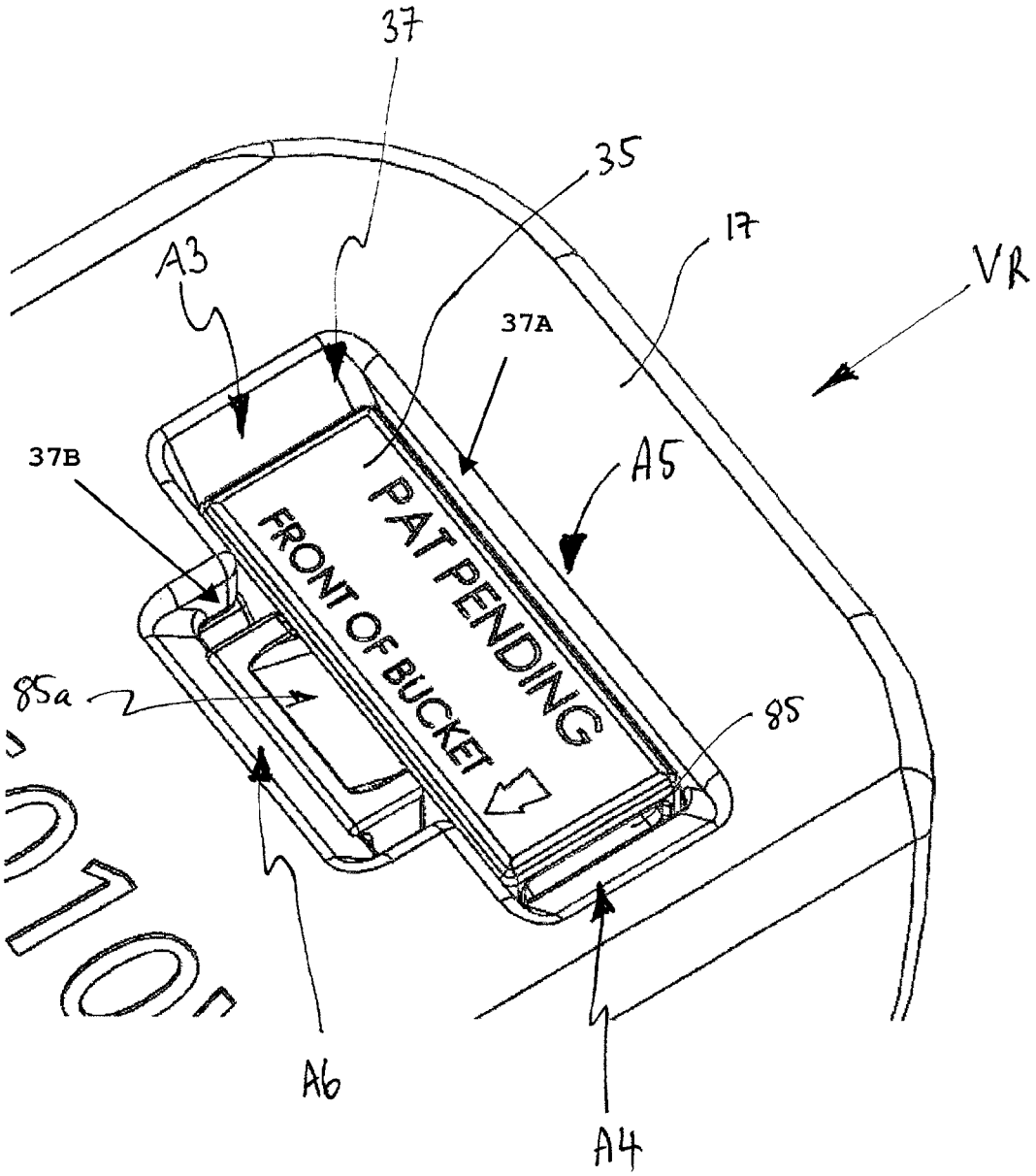
FIG. 29 shows a perspective view of the shroud (17) with the moveable jaw (35) having been inserted through the opening (37), and identifying other potential regions where retention means, devices, systems can be engineered to be established.

FIG. 29 shows other areas marked A3, A4, A5, and A6 adjacent the periphery of the upper opening 37 which could also be used for retention purposes using similar configurations, either attached/carried by the moveable jaw 35 or by regions/portions of the shroud 17.

As discussed above, for the case where one or more portions or components of the retention means/device comprises (either individually or in combination) an elastomeric component (for example, a rubber material), the elastomeric portion or component may be configured, whether attached with the moveable jaw 35 or the shroud 17, so as to be sufficiently compressible or elastically deformable so as to allow for insertion of the moveable jaw 35 through the upper opening 37 into a position relative to the shroud 17 for driving or moving of same, and transitionable to a condition that operates directly or indirectly with the shroud 17, moveable jaw 35, or the operable element 40 (as the case/configuration may require) to impede the moveable jaw 35 from lifting upwards out of its position relative to the shroud 17 thereby preserving said relative position.

For the case where one or more portions or components of the retention means/device comprises (either individually or in combination) a metallic component (eg. spring steel), the metallic portion or component may be formed or configured (for example, in a spring-like manner akin to that shown in FIG. 24), whether attached with the moveable jaw 35 or the shroud 17, so as to be sufficiently compressible or elastically deformable so as to allow for insertion of the moveable jaw 35 through the upper opening 37 into position relative to the shroud 17 for driving or moving of same, and transitionable to a condition that operates directly or indirectly with the shroud 17, moveable jaw 35, or the operable element 40 (as the case/configuration may require) to impede the moveable jaw 35 from lifting upwards out of its position relative to the shroud 17 thereby preserving said relative position.

The skilled reader will appreciate that many configurations could be developed that achieve the desired aim of the retention means/device in impeding the moveable jaw 35 from lifting upwards through the upper opening 37 once inserted therethrough/therein. Other hybrid arrangements (like that described above) could also be possible in which a metallic spring configuration is over-moulded with a suitable elastomeric material.

The shaping of the sides of the shroud 17 and/or various of the sides/faces of any of the components of the attachment assembly 25 (eg. the moveable jaw 35, any sides/faces of the operable element 40 that might be or become exposed via the rear side 24 of the shroud 17) could be configured with tapered and/curved faces to help in the expelling of accumulated fines, especially when the attachment assembly 25 is in a condition holding the GET $\mathbf{15}_C$ in position against the edge portion 10.

Of course, variations to various of the components described above are possible:

- the design (eg. shape and/or configuration) of the front portion of the shroud 17 can take various/multiple forms. Of course, other types of GETs 15, other than corner GETs $\mathbf{15}_C$ as described herein, can also be configured so as to operate with embodiments of the attachment assembly 25.
- the design (eg. shape and/or configuration) of the boss 32 and/or the fixed jaw 30 can differ. For example, the shaping of the interconnecting portions of both components can differ. While a 'dove-tail' "shoulder" profile of the boss 32 is used and described herein, this profile/configuration can differ. Any complementary shaping/configuration can be used. For example, an arrangement relaying on complementary shaped/configured interconnecting portions based around a "T" shape/configuration can be readily employed to achieve the required interconnection between the boss 32 and fixed jaw 30 (while operating to restrain both relative to each other in the appropriate axes).
- While welding of the boss 32 to the edge portion 10 of the bucket 5 is common, they can also be bolted in position.
- Use of the attachment assembly 25 with 'cast-in' bosses are also possible, for example where the boss 32 is cast with the lip portion 2. In such, instance, the fixed jaw 30 is configured so as to be interconnectable with the form of a boss that is cast with the lip portion 2. Or, for example, the form of an appropriate boss that is configured interconnectable with an existing (or otherwise) form of a fixed jaw 30, is provided to a third party for use in casting the boss with a lip portion 2;
- The form of the shroud 17 of the cast corner $\mathbf{15}_C$ and lip/blade could, of course, vary/differ.

FIGS. 16 to 20 show another embodiment of an attachment assembly 25' arranged in accordance with the principles described herein. Corresponding and analogous reference nomenclature used for describing the attachment assembly 25 is retained for ease of explanation, and differentiated in the form n'.

Figure 17:
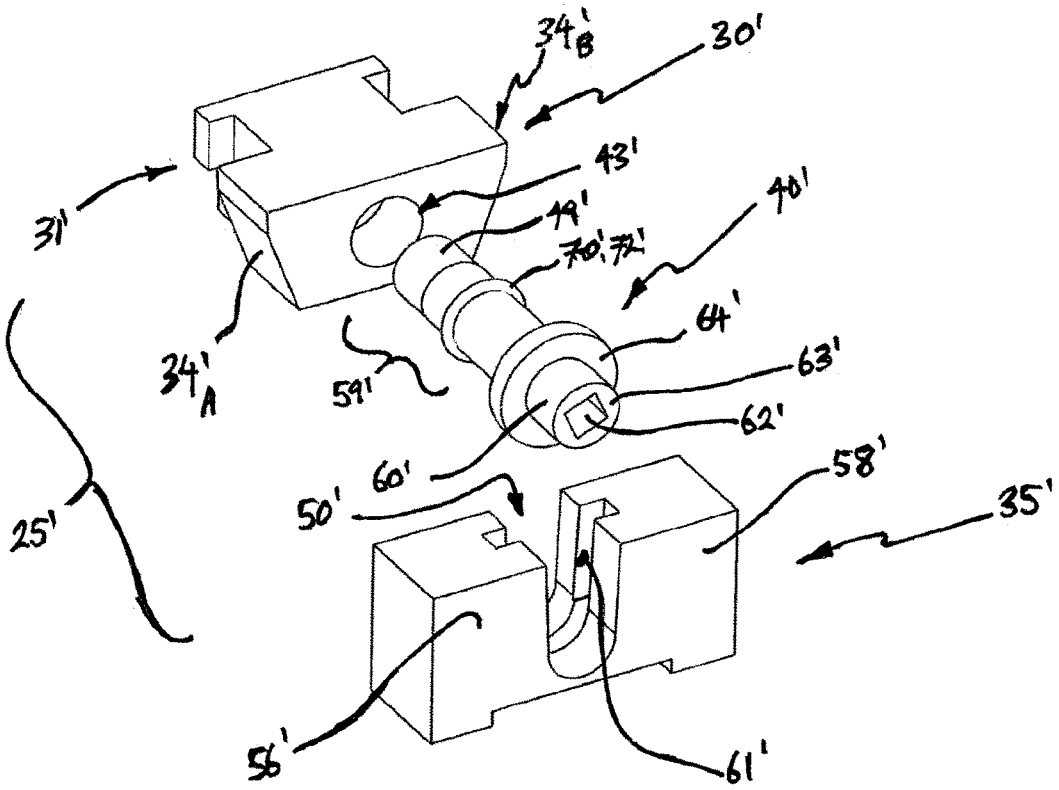
FIG. 17 shows a perspective exploded view of the embodiment of the attachment assembly shown in FIG. 16.
Figure 18:
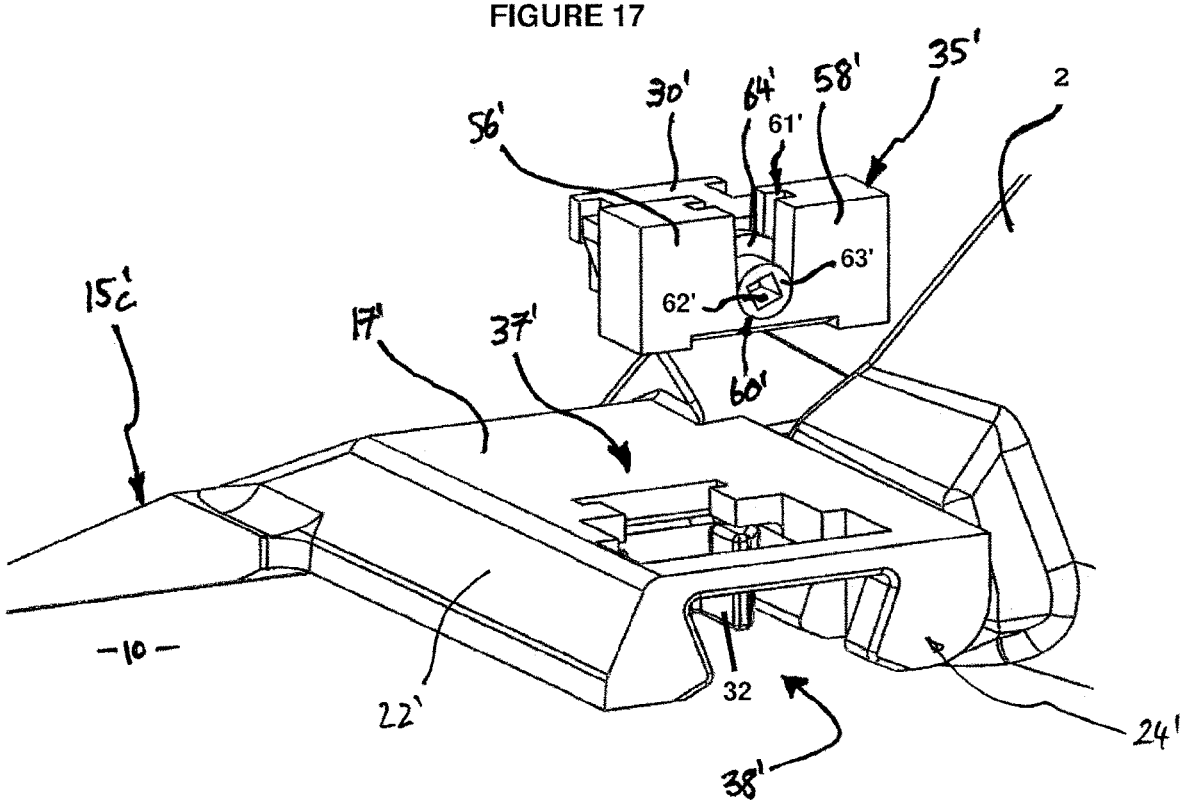
FIG. 18 shows a perspective view of an assembled version of the embodiment of the attachment assembly shown in FIG. 17 being placed in position for use in securing the GET with the bucket of the earth moving equipment/vehicle.
Figure 19:
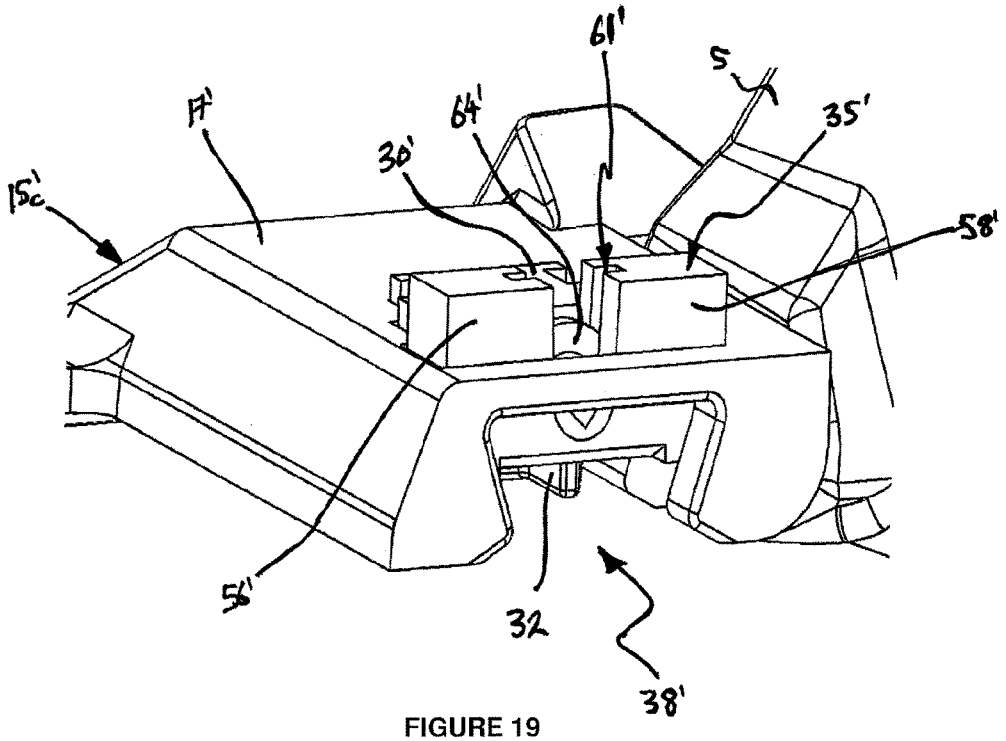
FIG. 19 shows an advancement of that shown in FIG. 18.

As can be seen from FIGS. 16 to 20, equivalent components are provided for the attachment assembly 25', resulting in functionality falling within the principles described herein. As seen in FIG. 19 and the attachment assembly 25' features a fixed jaw 30' that is placed in an interconnecting relationship with the boss 32, a moveable jaw 35' that is placed in an affirmative engagement with the shroud 17' of the GET 15'c (via the upper opening 37'), and an operable element 40' that operably associates the fixed 30' and moveable 35' jaws so that moving or driving of the moveable jaw 35' operates to hold the shroud 17' against the edge portion 10. For removal of the GET 15'C, the operable element 40' is operated so as to move or drive the moveable jaw 35' toward the fixed jaw 30' for reducing or removing the 'holding' force.

Figure 20:
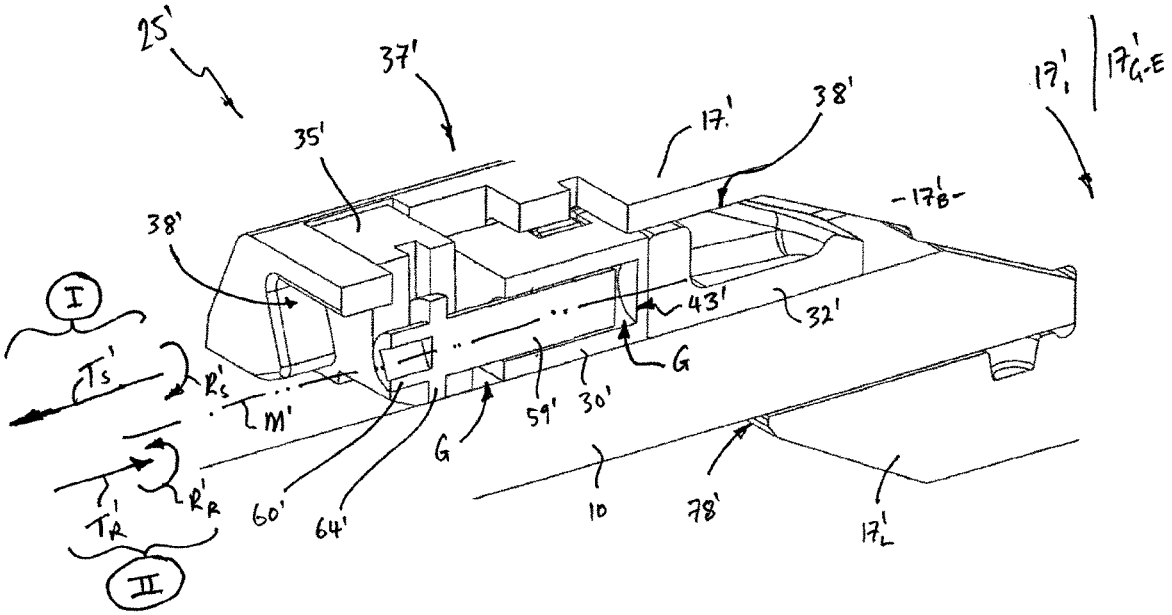
FIG. 20 shows a cross-section view of the embodiment shown in FIGS. 16 to 19, analogous to that shown in FIG. 14.

FIG. 20 shows a cross-section view of the attachment assembly 25' used to secure the shroud 17' in position against the edge portion 10. As will be clearly seen, the substance of the operable relationship between the functional components is substantially the same as that for the attachment assembly 25. Thus, it follows that the substance of the method of operation is also consistent as that for the attachment assembly 25 in both the first I' and second modes II'.

Of course, the method of separating the fixed 30/30' and moveable 35/35' jaws of the attachment assembly 25' can differ in that the operable element 40/40' can be arranged so as to not threadedly engaged with the blind hole 43/43' of the fixed jaw 30/30'. Instead, the shaft portion 59', once inserted, could be arranged so as to be rotatably supported in the blind hole so as to be rotatable about the axis M' and fixed so as to not translate axially along the axis M/M'. In such a configuration, the moving jaw 30/35' can be configured so as to be move/driven along the shaft by way of a threaded engagement with the shaft—such that, rotating of the head portion 60' moves/drives the moveable jaw 35/35' away from or toward the fixed jaw 30/30' as required.

Figure 21:
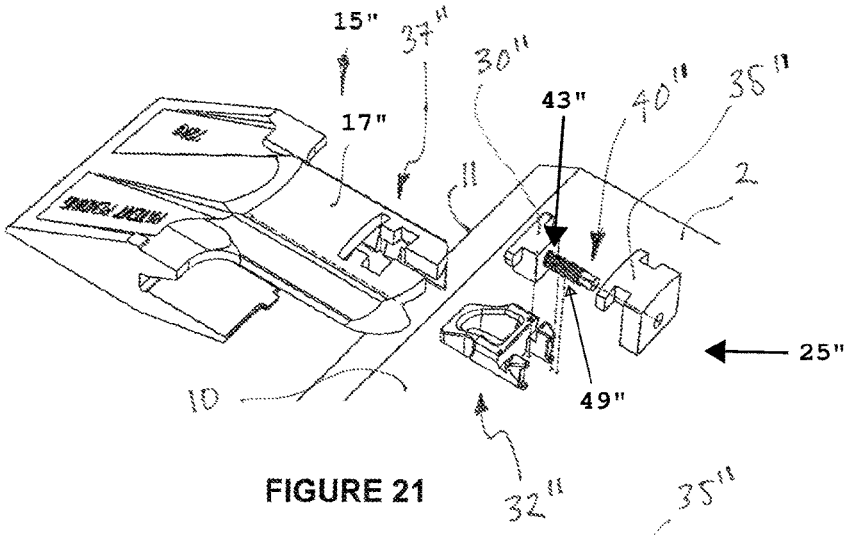
FIG. 21 shows an exploded perspective view of an embodiment which exemplifies a variation of the embodiment shown in FIGS. 16 to 20 (with GET removed)
Figure 22:
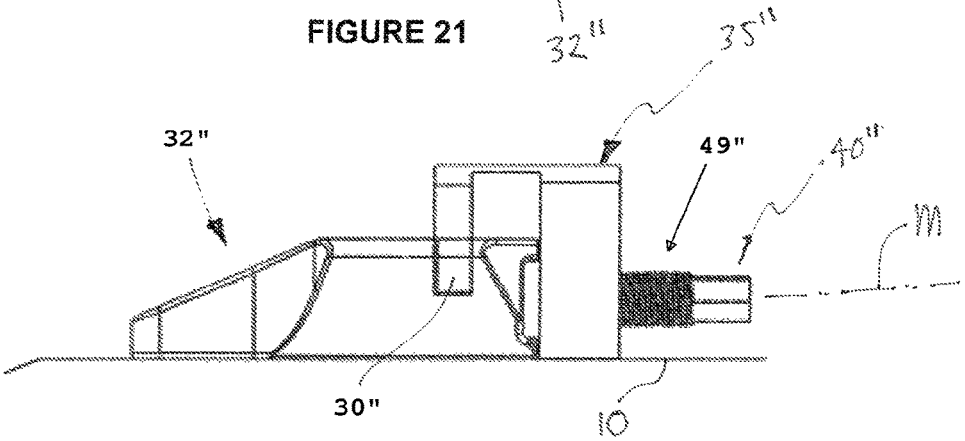
FIG. 22 shows an elevation view of an advancement of that shown in FIG. 21 in an assembly process (with GET removed)
Figure 23:
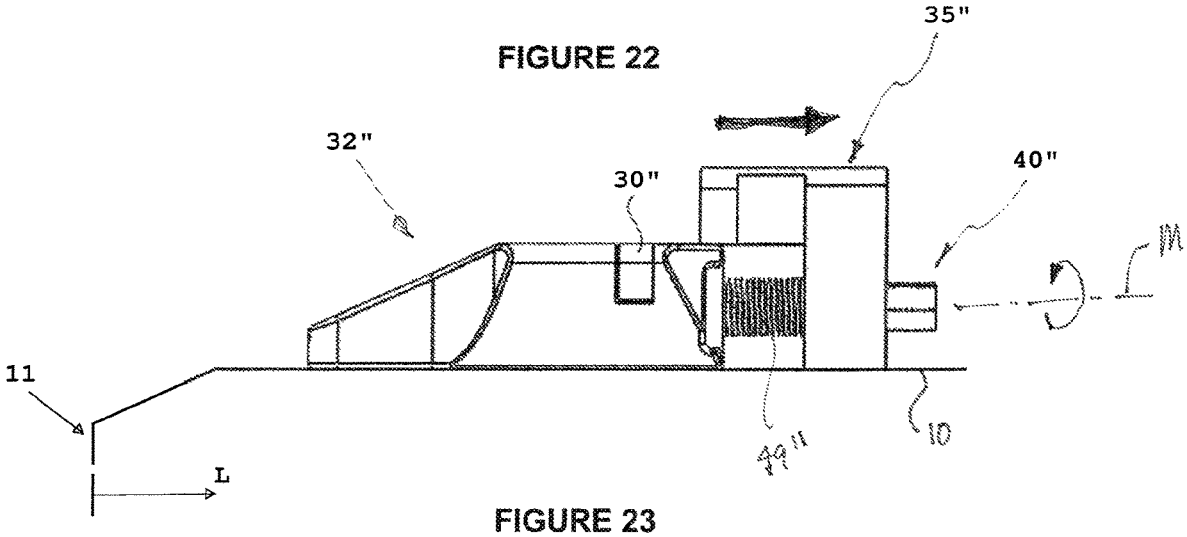
FIG. 23 shows an elevation view of a further advancement of that shown in FIG. 22 (with GET removed).

The skilled reader will appreciate other ways that such moving driving of the moveable jaw 35/35' could be achieved without departing from the principles described herein. For example, and with reference to FIGS. 21 to 23, arrangements can be realised in which the shaft portion of the operable element 40" is rotatably supported in the blind hole 43" so that the operable element 40" itself is unable to move or translate axially along the axis M (ie. away from the landing face 11 in increasing direction of axis L). In such an arrangement the moveable jaw 35" is configured so as to be arranged in threaded engagement with a threaded portion 49" of the operable element 40" so that the moveable jaw 35" moves axially there along on rotation of the operable element about the axis M. FIG. 21 shows the attachment assembly 25" (which represents a variation to the attachment assembly 25') in exploded form prior to assembly with the shroud 17" of a GET 15"$_C$. Once the shroud 17" is in position, the attachment assembly 25", when in assembled form, is inserted through the upper opening 37" so that the fixed jaw 30" interconnects with the boss 32", which is generally shown in FIG. 22 (where the GET itself is omitted for clarity) whereby the attachment assembly 25" is ready for operation. The upper opening 37" and the fixed jaw 30 are of different form to the embodiments described above, but sufficiently complementary so that the attachment assembly 25" can be slotted through the upper opening 37" in an assembled form for interconnection with the boss 32". FIG. 23 (again, with the GET 15"$_C$ omitted for clarity) shows the operability of the attachment assembly 25" on rotation of the operable element 40" about the axis M causing the moveable jaw 35" to translate axially (along axis M) by moving along the threaded portion 49" away from the landing face 11 in increasing direction of axis L, thereby spacing the fixed 30 and moveable 35 jaws from one another for causing driving of the shroud 17" against the edge portion 10 (and landing face 11). As noted above, removal of the holding force is achieved by the reverse operation of the operable element 40". Accordingly, while that shown in FIGS. 21 to 23 represents a different arrangement to that described above, the same relative movements are achieved, ie. for securement of the GET 15"$_C$ with the landing face 11/edge portion 10 of the lip portion 2, the fixed 30 and moveable jaws 35 are caused to be moved away from each other so as to subject the GET to a force holding the GET in position, and, for release, causing the fixed 30 and moveable jaw 35 to be moved toward each other so as to release or disrupt the holding force.

Figure 16:
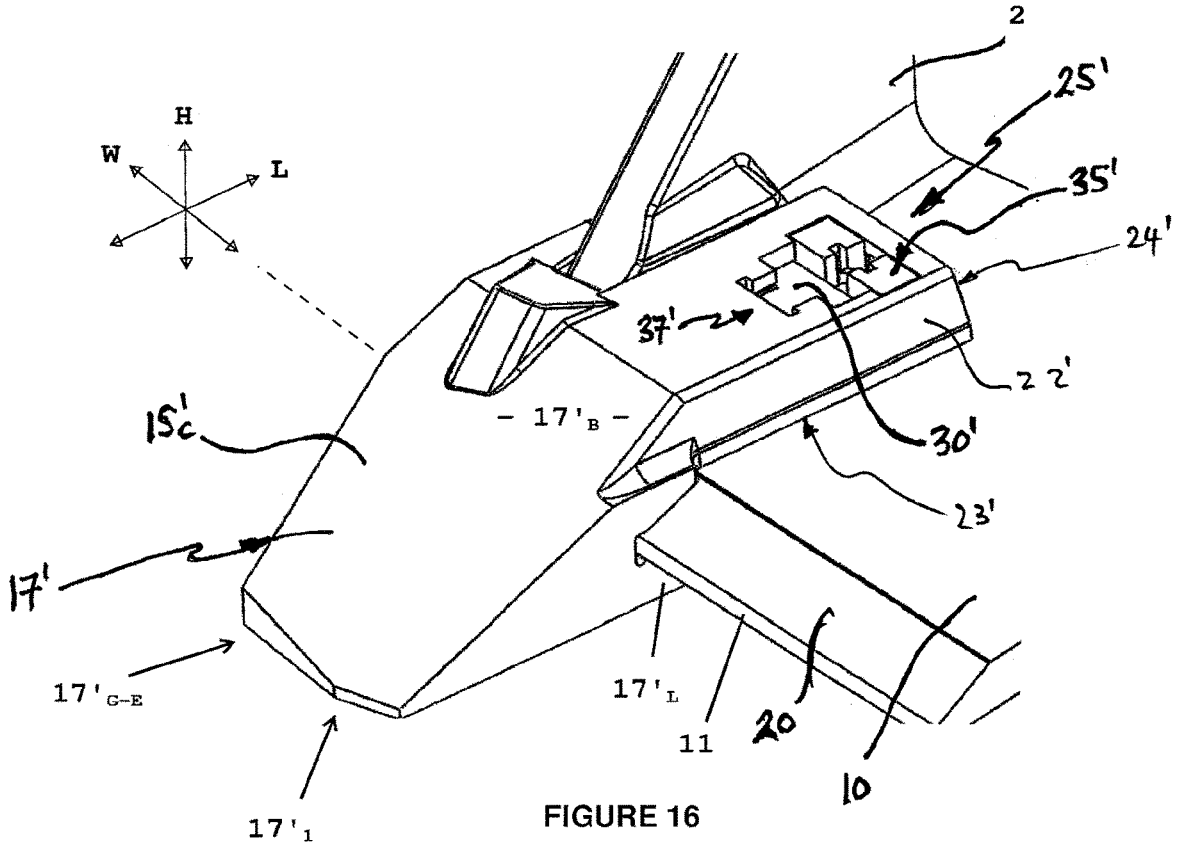
FIG. 16 shows a perspective view of another embodiment of an attachment assembly arranged in accordance with the principles described herein.

As will be seen from FIG. 17, the form/profile (and external shaping) of the fixed jaw 30' is substantially similar to that of the fixed jaw 30 of the attachment assembly 25. However, the form/profile of the moveable jaw 35' is different to its counterpart (moveable jaw 35) of the attachment assembly 25. As seen in FIGS. 16, 10 and 19, the upper opening 37' of the shroud 17' is larger than the upper opening 37 of the attachment assembly 25, but is still formed having a portion of its profile that corresponds with the profile of the moveable jaw 35' so that both can be placed in affirmative engagement with each other so that holding force/pressure can be applied for securement purposes, and affirmatively removed for removal purposes. As expected (and shown), the moveable jaw 35' is larger than the moveable jaw 35 of the attachment assembly 25.

Accordingly, in substance, the differences between the attachment assembly 25 and the attachment assembly 25' are as follows.

In the attachment assembly 25', all three components (ie. the fixed jaw 30', the moveable jaw 35', and the operable element 40') are assembled before engagement with the shroud 17', and then installed with the shroud through a larger configured opening 37' (as shown in FIGS. 16 and 20) in the top of the shroud 17' in one step. An advantage of this arrangement can be seen in that installation of the attachment assembly 25' can be conducted in a single step. An advantage of the larger profile opening of the upper opening 37' is that a failsafe release point is provided which can be used should the thread of the operable element 40', for example, seize up making extraction of the attachment assembly 25' difficult/stubborn. In this manner, access is provided at about the region where the moveable jaw 35' inserts via the upper opening 37' so that, in the event that, for example, the thread of the operable element 40' seizes up making a removal operation more challenging/difficult, access is provided/enabled for allowing a cutting means (such as for example, a grinding blade or oxy gas torch flame) to be used to severe the shaft 59' of the operable element 40' for facilitating easier removal of the operable element and the moveable jaw 35' from within the shroud 17' of the GET; for example, the cutting/severing process resulting in a portion of the length (eg. about 3-5 mm) of the operable element 40' (eg. its shaft portion 59') being eliminated so as to generate enough clearance or play so that both the operable element 40' and the moveable jaw 35' can be freed up and manipulated from within the confines of the shroud 17' of the GET. Indeed, the same space (slightly smaller in size) is shown in FIG. 12 adjacent the lower terminal edge of the angled/inclined face 80$_C$ where a small gap (generally provided by way of the smaller size space 37B of the upper opening 37) is provided between said lower terminal edge and the larger space 37A of the upper opening 37 which will soon be occupied by the moveable jaw 35 (once inserted through the upper opening 37).

With reference to FIG. 20, it will be appreciated that the larger profile of the upper opening 37' allows access to the portion of the operable element 40' between the fixed 30' jaw and the moveable jaw 35', which portion is indicated generally by reference "G" in FIG. 20. As the skilled reader will appreciate, seizing of the attachment assembly 25' when securing the shroud 17' against the landing face 11/edge portion 10 of the lip portion 2 involves significant force residing in the relevant components in maintaining the required securing/holding force (ie. the force holding the GET with the landing face 11/edge portion 10). Seizing of the attachment assembly 25' can prevent the attachment assembly from being operated to release such force. Thus, cutting or severing of the portion of the operable element 40' between the fixed 30' and the moveable 35' jaws enables the (holding) force to be released or sufficiently disrupted/reduced by providing clearance for any of the operable components of the attachment assembly 25' to be manipulated for removal purposes.

However, a disadvantage of this arrangement is that, for the shroud 17' to be removed, the complete assembly of the fixed jaw 30', operable element 40' and moveable jaw 35' needs to be removed also in a single step which requires aligning the assembled components appropriately with the generally complex profile of the upper opening 37' in view of the shroud 17' moving over the f fixed jaw 30' when the attachment assembly 25' is tightened—making such (re) alignment for removal purposes difficult (and/or time consuming) after use.

In the attachment assembly 25, two of the components are first assembled as an initial assembly in that the threaded shaft portion 49 of the operable element 40 is first threadedly engaged with the blind hole 43 of the fixed jaw 30—in one commercial form, the operable element 40 is provided pre-installed or pre-fitted in the fixed jaw 30. Once this initial assembly is complete, the fixed jaw 30 (with the operable element 40 threadedly engaged therewith) is interconnected with the boss 32, following which the shroud 17 is then positioned in place over the boss 32 and the interconnected fixed jaw 30 (and operable element 40). The next step is the insertion of the moveable jaw 35 into the opening 37 so as to engage the annular flange 64 with the slot 61 for interconnecting both components (the profile of the upper opening 37 being comparatively smaller and less complex than that of the upper opening 37', as shown in FIG. 16). Advantageously, while the moveable jaw 35 is inserted after the shroud 17 is positioned in placed as a separate step, the moveable jaw 35 is positioned through a smaller opening (upper opening 37) in the top of the shroud 17 which offers a less complex profile and does not require any substantive realignment for removal purposes. In at least one aspect, the reduced complexity of the profile of the upper opening 37 provides less opportunity for fines to accumulate. While the installation of the GET $\mathbf{15}_C$ using the attachment assembly 25 requires more steps than that required for the attachment assembly 25', removal of the GET $\mathbf{15}_C$ can be easier and safer than removal of the GET $\mathbf{15'}_C$ using the attachment assembly 25'.

Thus, in at least one practical installment process, the fixed jaw 30 and the operable element 40 are installed, or interconnected with, the boss 32 as an initial process. Once complete, the shroud 17 is then introduced over the boss 32. Once the shroud 17 is fitted over the boss 32, the moveable jaw 35 is dropped in through the upper opening 37 (from above). The latter process, which benefits from the operability between the moveable jaw 35 and the operable element 40 via the positive engagement between the slot 61 and the annular flange 64, enables the moveable jaw 35 to be easily inserted (and removed when needed) for connection with the annular flange 64 through the upper opening 37—which results in a much simpler arrangement than some existing solutions, especially for the removal process.

For example, having regard to one such existing solution (described in U.S. Pat. No. 9,540,796—U.S. '796), the installation process described involves, firstly, the relevantly described GET (20) being placed onto the relevantly described boss (24). Then, insertion of the main componentry of the relevantly described connection means (30) into a recess into the GET mounted over the boss on the bucket lip. U.S.'796 describes two situations:

1. Where the connection means is protected but requires an additional spacer block (58) to fill the gap that permits the insertion.
2. Where the additional spacer block is not required—in this case the main componentry of the connection means is inserted into an elongate upper opening in the GET, but results in components of the connection means being more exposed to wear during ground engaging activity than the use of the additional spacer.

For the most part, installation of such assemblies is straight forward, as all relevant componentry is new and clean. A significant issue, however, is in the removal process following the hostility of ground engaging activity causing to ingress fines (and any other related debris) into any exposed gap, recess, or cavity of the equipment resulting in damage or seizing of functional componentry.

With the presently described principles, all that is needed is to operate the operable element 40 enough so as to release the force being applied to the moveable jaw 35. This is the same regardless of how far out (or spaced) from the fixed jaw 30 the annular flange 64 has been driven during the installation process (typically, in the order of between from about 2 mm to about 3 mm is sufficient for applying the necessary retaining or holding force for securement of the shroud 17. At this point the moveable jaw 35 can be prised out (for example, using any of the apertures 85) so as to free the shroud 17. Additional rotation of the operable element 40 would serve to drive or push the shroud 17 forward (in the direction $T_R$—translate release—as shown in FIG. 14), as outlined above.

By comparison, the solution described in U.S.'796 is disadvantageous for at least the following:

1. The bolt (36) of the connection means described in U.S.'796 needs to be retracted the total distance (up to about 15 mm, or potentially more). As noted above, physical retraction is often not easy with the presence of fines and, in some cases, impossible if seized. Only when the bolt is fully retracted can the spacer be prised out and the main componentry removed. Removing the main componentry comes with complications with the GET still being in place.
2. Using the 'no spacer' option attracts substantially the same practical disadvantage as above.

In the attachment assembly 25', the opening 50' of the moveable jaw 35' that captures the annular flange 64' of the operable element 40' opens to the upper side of the moveable jaw 35' (relative to its assembled condition, as shown in FIGS. 17 and 18). In the attachment assembly 25, the opening 50 opens to the lower side of the moveable jaw 35 (relative to its assembled condition, as shown in FIG. 6).

In the attachment assembly 25', to remove the shroud 17' the full locking assembly needs to be removed (unless the threaded shaft portion 59' is cut). This generally requires alignment with shroud opening 37' which is very difficult after use. In the attachment assembly 25, only the moveable jaw 35 needs to be removed (through the upper opening 37). Thus, no alignment is required.

In the attachment assembly 25', due to the head portion 60' of the operable element 40' being smaller, the recess or drive cavity 62' provided in the face 63' is smaller, and generally less convenient for engagement by a drive or rotation tool, as compared the attachment assembly 25 where the head portion 60 is larger and the recess or drive cavity 62 correspondingly larger.

Modifications and variations may be made to the present invention within the context of that described herein and shown in the drawings. Such modifications are intended to form part of the inventive concept described in this specification.

The invention claimed is:

1. An attachment assembly for releasably securing a ground engaging tool (GET) with earthmoving equipment, the attachment assembly comprising:

a first body configured for placement in affirmative engagement with a portion of or in fixed relation with respect to an edge of or associated with the earthmoving equipment;

a second body configured for placement in affirmative engagement with a portion of the GET;

a driveable element operably associating the first and second bodies so as to be responsive to operation of the driveable element in:

a first mode in which the second body is moved or driven away from the first body with the GET received with respect to said edge, the separation of the bodies operating to apply a force to said portion of the GET for holding the GET with respect to said edge, and a second mode in which the second body is moved or driven toward the first body thereby releasing said force for removal of the GET, wherein the second body comprises a slotted region configured so as to receive a portion of or carried by the drivable element for forming an engagement or interconnection therebetween for enabling driving movement of the second body via operation of the drivable element in the first and second modes, wherein the second body is configured having one or more portions thereof that interact with or bear against respective corresponding portions of the GET so that the GET follows or is driven by movement of the second body in either of the first, second modes of operation in response to operation of the drivable element, and wherein the attachment assembly is configured so that the second body is insertable through an opening provided in a side of the GET for engaging or interconnecting the slotted region with a portion of the drivable element and positioning the second body relative to the GET so as to enable said portion(s) of the second body to interact with or bear against said respective corresponding portion(s) of the GET for driving or moving of same in the first, second modes of operation via operation of the drivable element.

2. An attachment assembly according to claim 1, wherein said portion of or in fixed relation with the edge is provided in the form of a boss welded or cast at or near a wear edge of or associated with an excavator bucket of the earthmoving equipment.

3. An attachment assembly according to claim 2, wherein the GET comprises a body having a ground engaging region at a first end of said body, the body of the GET comprising a leg portion which extends away from the first end of the body and which is spaced from said body so as to define an opening configured for snugly receiving a portion of the wear edge during fitment of the GET.

4. An attachment assembly according to claim 2, wherein the first body is configured at or near a first end thereof so as to interconnect with the boss, the interconnection between the first body and the boss serving to place both in fixed relation with each other in a direction substantially orthogonal to the wear edge or its distal extent.

5. An attachment assembly according to claim 1, wherein the drivable element is of cylindrical form having an axis about which the drivable element is movable or rotatable, whereby rotation of the drivable element in one direction of rotation serves to enable operation of the first mode, and rotation in the alternate direction of rotation serves to enable operation of the second mode.

6. An attachment assembly according to claim 5, wherein the drivable element comprises or is provided in the form of a piston having a head portion and a shaft portion extending from the head portion, the head portion configured so as to be engageable with or by a driving tool, which engagement is operable for moving or rotating the drivable element about its axis of rotation.

7. An attachment assembly according to claim 6, wherein the GET comprises a further opening formed in a side thereof configured so as to allow access to the head portion of the drivable element for operation thereof via the driving tool.

8. An attachment assembly according to claim 6, wherein the first body comprises a hole having a thread configured for threaded engagement with a threaded portion provided with said shaft portion.

9. An attachment assembly according to claim 8, wherein the drivable element carries or is operable with one or more annular seal elements arranged concentric with or carried by the shaft portion, the or each seal element positionable relative the shaft portion so as to protect one or more regions of thread or of threaded engagement from ingress of debris during ground engaging operations.

10. An attachment assembly according to claim 8, wherein the drivable element comprises or carries an annular flange spaced along the shaft portion from the head portion, the engagement or interconnection between the drivable element and the second body for enabling driving movement thereof being established by way of a portion of the annular flange being receivable in the slotted region of the second body.

11. An attachment assembly according to claim 10, wherein drivable association of the first and second bodies via the drivable element is by way of the threaded engagement of the hole with the drivable element and the engagement or interconnection established by way of the receiving of the portion of the annular flange in the slotted region of the second body.

12. An attachment assembly according to claim 10, wherein the second body is configured so as to increase or maximise the portion of the annular flange received or accommodated within the slotted region.

13. An attachment assembly according to claim 1, wherein the assembly further comprises, or is arranged operable with, a retention means or device operable between a portion of the second body and a portion of the GET or the drivable element for establishing mutual engagement or interaction that is operable for retaining or preserving the position of the second body relative to the GET following insertion of the second body through or into the second GET's opening, and wherein the retention means or device comprises:

(i) a metallic material, or (ii) an elastomeric material, or (iii) a combination of both a metallic material and an elastomeric material.

14. An attachment assembly according to claim 1, wherein a profile or shape of the opening of the GET through which the second body is insertable is substantially complementary with a profile or shape of at least one side or aspect of the second body so as to enable the second body to be insertable through the opening for said relative positioning of the second body with the GET for establishing affirmative engagement therebetween.

15. A method of attaching a ground engaging tool (GET) with a leading or wear edge of or associated with earthmoving equipment, the method comprising:

forming, providing or configuring an attachment assembly according to claim 1 for releasably securing the GET with said edge, arranging the first body in operable association with the drivable element, and in affirmative engagement with said portion of or in fixed relation with respect to said edge, positioning the GET in respect of said edge such that a portion thereof receives said portion of or in fixed relation to said edge, arranging the second body in operable association with the drivable element and in affirmative engagement with said portion of the GET, operating the drivable element so as to separate the bodies for applying a force to the GET for holding same with respect to said edge.

16. A method of releasing a ground engaging tool (GET) secured with a leading or wear edge by way of the attachment assembly of claim 1, the method of releasing the GET comprising: operating the drivable element so as to reduce said spaced or separated relation of the first, second bodies for reducing the force applied to the GET for securement purposes.

* * * * *